US006575100B2

(12) United States Patent
Faucher et al.

(10) Patent No.: US 6,575,100 B2
(45) Date of Patent: Jun. 10, 2003

(54) SUPPORT STRUCTURES

(75) Inventors: Martin Faucher, Katevale (CA); Michel Corriveau, Eaton (CA); Michael Moliner, Eastman (CA)

(73) Assignee: BHM Medical Inc., Magog (CA)

( * ) Notice: Subject to any disclaimer, the term of this patent is extended or adjusted under 35 U.S.C. 154(b) by 0 days.

(21) Appl. No.: 09/820,951

(22) Filed: Mar. 30, 2001

(65) Prior Publication Data

US 2002/0014568 A1 Feb. 7, 2002

(30) Foreign Application Priority Data

Mar. 31, 2000 (CA) ..... 2303619

(51) Int. Cl.[7] ..... E01B 23/00

(52) U.S. Cl. ..... 104/126; 104/93; 104/118; 248/354.1

(58) Field of Search ..... 104/89, 91, 93, 104/118, 126; 248/354.3, 122.1, 354.1

(56) References Cited

U.S. PATENT DOCUMENTS

| | | | | | |
|---|---|---|---|---|---|
| 2,630,076 | A | | 3/1953 | Stieve | 104/126 |
| 2,683,890 | A | * | 7/1954 | Rosenbaum | 16/87.4 R |
| 2,683,891 | A | * | 7/1954 | Rosenbaum | 16/87.4 R |
| 2,916,034 | A | * | 12/1959 | Detwiler | 104/126 |
| 3,000,329 | A | | 9/1961 | Fargo et al. | 104/126 |
| 4,296,509 | A | | 10/1981 | Simmons et al. | 5/81 R |
| 4,564,247 | A | * | 1/1986 | Knoop | 384/19 |
| 4,579,322 | A | | 4/1986 | Schwarz | 269/70 |
| 4,671,479 | A | * | 6/1987 | Johnson et al. | 248/173 |
| 4,789,120 | A | * | 12/1988 | Spidel | 182/141 |
| 4,869,280 | A | | 9/1989 | Ewing | 135/69 |
| 4,967,669 | A | * | 11/1990 | Kuchta | 104/106 |
| 5,018,933 | A | | 5/1991 | Kramer | 414/542 |
| 5,056,753 | A | | 10/1991 | Luneau et al. | 248/542 |
| 5,102,173 | A | | 4/1992 | Schallern | 292/288 |
| 5,238,213 | A | * | 8/1993 | Pool | 248/354.1 |
| 5,317,855 | A | * | 6/1994 | De Leeuw | 248/354.3 |
| 5,337,908 | A | | 8/1994 | Beck, Jr. | 212/189 |
| 5,568,954 | A | * | 10/1996 | Burgess | 248/354.3 |
| 5,694,654 | A | | 12/1997 | Roy | 5/83.1 |
| 5,809,591 | A | | 9/1998 | Capaldi et al. | 5/83.1 |
| 5,826,847 | A | * | 10/1998 | Warner et al. | 248/354.1 |
| 5,833,199 | A | * | 11/1998 | Benting et al. | 248/414 |
| 5,913,783 | A | * | 6/1999 | Weener et al. | 248/354.1 |
| 6,269,751 | B1 | * | 8/2001 | Hauck et al. | 104/93 |
| 6,318,011 | B1 | * | 11/2001 | McCudden | 40/606 |

FOREIGN PATENT DOCUMENTS

| | | |
|---|---|---|
| CA | 2217421 | 3/1997 |
| EP | 1101480 | 11/2000 |
| EP | 1127662 | 2/2001 |
| FR | 2193773 | 7/1973 |
| FR | 2527713 | 5/1982 |
| GB | 770770 | 3/1955 |
| WO | WO 82/03165 | 9/1982 |
| WO | WO 99/00935 | 1/1999 |

* cited by examiner

*Primary Examiner*—S. Joseph Morano
*Assistant Examiner*—Lars A. Olson
(74) *Attorney, Agent, or Firm*—Ronald S. Kosie; Robert Brouillette

(57) ABSTRACT

The present invention relates to support structures. The present invention in particular relates to a telescopic track as well as a telescopic mast assembly which may for example be exploited in the context of a person (e.g. patient) handling system.

12 Claims, 28 Drawing Sheets

18
6
20
22
24
170

SUPPORT STRUCTURES

The present invention relates to support structures. The present invention in particular relates to support structure components which may be used together; these components may, however, also be used alone in the sense that they may be used independently of the other components of the present invention. A support structure comprising a component of the present invention may for example be used in the context of providing a support for a person. The present invention also, for example, relates to an overhead support structure or frame comprising one or more of the components of the present invention. Such an overhead support structure or frame may for example be used in the context of providing a person handling system for lifting and transferring a person from one location to another. The present invention in particular for example relates to a telescopic track as well as a telescopic mast assembly which may for example be exploited in the context of a person (e.g. patient) handling system.

Support structures are known for lifting and transferring loads as well as people; please see for example U.S. Pat. Nos. 5,809,591, 5,694,654, 5,337,908 and 3,000,329; please also see for example International patent application number PCT/CA98/00935 which relates to a winch for such a person handling system and which was published under International Publication number. WO 99/17704 (the entire contents of which is hereby incorporated by reference).

In the following particular attention will be made to the use of the components and a frame in the context of supporting a person and in particular to person lifting and transferring systems by way of example only; the components and frame may of course be used for the purpose of transferring other types of loads and providing other types of support.

There is a continuing need for structures for supporting a person and in particular for a rail or track support structure or frame which can be used to raise, displace and lower a (e.g. incapacitated) person e.g. displace a person between a bed or chair and a bath area etc.; such support structures may be needed in many environments such as in private homes, hospitals, rehabilitation centres, group homes for the aged, etc.

Known mast or pole structures used with overhead rails or tracks for forming support structures or frames may have their longitudinal lengths adjusted by relying on pairs of lock holes and lock pins (see for example U.S. Pat. Nos. 3,000,329 and 2,630,076). These adjustment mechanisms are also relatively cumbersome to use. See also U.S. Pat. No. 2,630,076.

Other known overhead track mechanisms or systems are either directly bolted or otherwise fixed to the ceiling of a room or are maintained in place by mast or support rod assemblies which are relatively complex structures to set in place. These structures are intended to be more or less permanent fixtures i.e. the structures are usually not intended to be knocked down once set in place.

Known mast structures for use alone or for support frames are also deficient in that if the longitudinal pressure (i.e. between the floor and ceiling) is too low, the post or mast may not provide sufficient support and may collapse when being used resulting in injury to a person using such structure.

It is, however, for example, known to provide a support post having an upper end for abutment against a ceiling (or other object) and a lower end for abutment against to a floor (or other object); see U.S. Pat. No, 5,056,753. In this known mast structure, the length of the post or mast may be adjustable such that it may be longitudinally extended, thereby causing the upper and lower ends to abut firmly against the ceiling and floor, respectively, and to accommodate different room heights. However the type of mast structure shown cannot be easily set up or broken down in relatively quick order; this would be especially so in relation to a rail or track support structure or frame which comprises an overhead track or rail component.

It would be advantageous to have a track (or rail) component and/or a mast assembly which may be relatively easily built up and knocked down and which components can be readily length adjusted to accommodate the area of use. It in particular would be advantageous to have a track or rail the length of which may be adjusted during installation of a track or rail support system. It would also be advantageous to have a rail or track support system which could be easily transferred from one location to another location as the need arises. It would further be advantageous to have a rail or track support structure which has a rail or track supported by masts or post which provide the necessary lateral support during use by an individual.

STATEMENT OF INVENTION

In accordance with one aspect the present invention provides a telescopic track, said track comprising an inner section and an outer section, said outer section having an exterior side and an interior side, said inner section being disposed on the interior side of said outer section so as to be telescopically displaceable in and out of said outer section said outer and inner sections defining a travel channel for a trolley means comprising a trolley connector projection, said outer section having a longitudinally extending first opening through which may extend said trolley connector projection, the first opening of the outer section being defined by opposed inwardly extending slot projections extending into the interior side of the outer section, each of the slot projections terminating in a respective first interior support surface, said inner section having a longitudinally extending second opening through which may extend said trolley connector projection, the inner section having interior surface portions bordering the second opening on opposite sides thereof defining respective second interior support surfaces, the slot projections being adapted (or configured) to register within the second opening such that the first and second interior support surfaces are in an essentially common plane and define a travel support surface for the trolley component.

In accordance with the present invention a telescopic track may comprise a plurality of the inner sections coupled together by a plurality of the outer sections. In accordance with the present invention a telescopic track may comprise two of the inner sections coupled together by an outer section. In accordance with the present invention a travel channel may be a tubular travel channel, i.e. have a tunnel like aspect. Alternatively a travel channel may have a U-shaped cross section, i.e. be open from above. A telescopic track, may for example be used as part of a person support system comprising an overhead track; a telescopic track may be supported by a system of masts of known type or for example a system of masts as described herein. Alternatively, instead of using one or more masts, a track may be supported in any other suitable fashion; e.g. a track having a pair of opposed longitudinal slots as described herein may be supported by T-shaped hangers extending downwardly from a ceiling, the head of the T thereof being engaged in the travel channel with the root thereof extending out of the longitudinal slot to the ceiling to which it is attached.

In accordance with another aspect the present invention provides a telescopic mast assembly, said telescopic mast assembly having a longitudinal axis and comprising an outer section having an interior side and an exterior side, an inner section, said inner section being disposed on the interior side of said outer section so as to be telescopically displaceable in and out of said outer section along said longitudinal axis, and a releasable snap lock component comprising bias means, a lock projection, a plurality of longitudinally spaced first lock openings defined by one of said inner and outer sections and a second lock opening defined by the other section, said outer section, said inner section, said bias means, said lock projection and said second opening being configured such that said second lock opening is alignable with said first lock openings and such that when said second lock opening is aligned with a first lock opening said lock projection is displaceable between a biassed lock position and an unlock position said bias means being configured so as to able to bias said lock projection in said biassed lock position wherein when said lock projection is in said biassed lock position said lock projection is disposed in said second lock opening and in the first lock opening so as to inhibit telescopic displacement of said inner section along said longitudinal axis relative to said outer section, and wherein when said lock projection is in said unlock position said inner section is telescopically displaceable along the longitudinal axis relative to said outer section.

In accordance with the present invention the outer section may define the plurality of first openings and the inner section may define the second lock opening.

In accordance with the present invention a telescopic mast assembly may for example comprise two releasable snap (or quick) lock components. In this case the mast assembly may, for example comprise two (i.e. a pair of) opposed lock projections and two (i.e. a pair of) opposed second openings defined by the inner section. In this case the outer section may also define a plurality of pairs of opposed first lock openings, the pairs of first openings being longitudinally spaced apart. If desired or necessary, however, the first lock openings need not be paired so as to be disposed opposite each other; they may be offset relative in some suitable or desired fashion (with corresponding displacements of the lock projections and second lock openings). The two releasable snap lock components may comprise separate biassing means or share a common biassing means (e.g. a common helical spring); in any case the biassing means is of course to be configured so as to able to bias each of said lock projection in a respective said biassed lock position.

In accordance with the present invention a lock projection may include a lock notch. The lock notch may be configured to seat a part of the inner section which is configured to register therein so as to inhibit displacement of the lock projection between the lock position and the unlock position when the mast component as a whole is under compression between the upper and lower support surfaces. The part of the inner section to be seated in the lock notch may for example comprise the peripheral edge or rim which defines the second opening or it may comprise a projection defined by the inner section.

In accordance with the present invention the lock projections may be provided with an upper cammed (or cam) surface for facilitating the quick outward telescoping displacement of the inner section, i.e. such that a snap lock occurs once the speed of withdrawal of the inner section falls below a predetermined threshold value (such threshold speed and cam shape of the lock projection may be found by empirical tests keeping in mind the desire to allow quick withdrawal while avoiding a snap lock at an undesired first lock opening).

In accordance with the present invention a mast assembly may if so desired comprise adjustment means for adjusting (i.e. fine tuning) the compression force to which the mast assembly is subjected to during use, namely length adjustment means able to alter or tend to alter the length of the mast assembly.

Accordingly, a mast assembly as provided by the present invention may, for example, be one wherein said inner section comprises an extension component and a base component, wherein said base component comprises said bias means, said lock projection and defines said second lock opening of said releasable snap lock component, wherein said outer section and said base component are configured to cooperate so as to inhibit rotation of said base component about said longitudinal axis relative to said outer section and wherein said mast assembly further comprises coupling means for screw coupling said extension component and said base component together such that, when said base component is locked by the releasable snap lock component so as to inhibit displacement of said inner section along said longitudinal axis relative to said outer section, rotation of the extension component about the longitudinal axis relative to the base component is able to induce displacement of said extension component relative to said base component along said longitudinal axis.

In accordance with another aspect of the present invention there is more generally provided a mast assembly having a longitudinal axis and comprising an outer section having an interior side and an exterior side, an inner section comprising an extension component and a base component, said inner section being disposed on the interior side of said outer section so as to be telescopically displaceable in and out of said outer section along said longitudinal axis, a releasable lock means for locking the inner section in place with respect to said outer section so as to inhibit displacement of said inner section along said longitudinal axis relative to said outer section anti-rotation means configured so as to be able to inhibit rotation of said base component about said longitudinal axis relative to said extension component and said mast assembly further comprises coupling means for screw coupling said extension component and said lower component together such that when said inner section is locked in place relative to the outer section so as to as to inhibit displacement of said inner section along said longitudinal axis, rotation of the extension component about the longitudinal axis relative to the base component is able to induce displacement of said extension component relative to said base component along said longitudinal axis.

In accordance with the present invention one end (e.g. the lower end) of the mast assembly may if so desired or necessary be adapted or configured in any suitable (known)

manner for engaging a lower support surface (e.g. floor); see for example U.S. Pat. No. 5,056,753. It may for example be configured to releasably engage a pedestal plate which can present a relatively large abutment surface area to the lower support surface so as to spread the load on the lower surface over a relatively large area.

Similarly, in accordance with the present invention the other end (e.g. upper end) of the mast assembly may if so desired or necessary be adapted or configured in any suitable (known) manner for engaging an upper support surface (e.g. ceiling); see for example U.S. Pat. No. 5,056,753. It may for example be configured to releasably engage a load spreader plate which can also present a relatively large abutment surface area to the upper support surface so as to spread the load on the upper surface over a relatively large area.

In accordance with the present invention the engagement means between the mast assembly and a pedestal plate and/or load spreader plate may include a compression spring acting between a respect end of the mast assembly and a pedestal plate and/or load spreader plate as the case may be.

In accordance with the present invention each mast assembly may be associated with its own a pedestal plate and load spreader plate. However, if so desired, two or more mast assemblies may share a common pedestal plate member and/or a common load spreader plate to which they may be releasably attached during use.

A telescopic mast assembly as described herein may for example be used alone as a self standing support structure, i.e. for supporting objects or as a support pole for assisting a person to stand up or to sit down. On the other hand a telescopic mast assembly as described herein may, for example, be used as a mast component for supporting an overhead track component of a person support system. The person support system may comprise any desired track member; it may for example, comprise a telescopic tack as described herein.

In accordance with an additional aspect the present invention provides in a person support system for use in a room having a floor and a ceiling, said system comprising an overhead track component having opposed ends at least two upstanding mast components connecting means connecting each end of said track component to a respective mast assembly the improvement wherein said overhead track component comprises one or more telescopic tracks as defined herein.

In accordance with the present invention there is provided in a person support system for use in a room having a floor and a ceiling, said system comprising an overhead track component having opposed ends at least two upstanding mast components connecting means connecting each end of said track component to a respective mast assembly the improvement wherein said mast components comprise one or more mast assemblies as defined herein A person support system for use in a room having a floor and a ceiling, said system comprising an overhead track component having opposed ends at least two upstanding mast components connecting means connecting each end of said track component to a respective mast assembly wherein at least one of said mast components is of telescopically variable length and comprises a component of compression variable length for causing upper and lower ends thereof to respectively engage upper and lower support surfaces.

In accordance with the present invention there is further provided a kit for a person support system comprising an overhead track component, a mast component and releasable connecting means for connecting said overhead track component to said mast component wherein said overhead track component comprises a telescopic track, said track comprising an inner section and an outer section, said outer section having an exterior side and an interior side, said inner section being disposed on the interior side of said outer section so as to be telescopically displaceable in and out of said outer section, said outer and inner sections defining a travel channel for a trolley means comprising a trolley connector projection, said outer section having a longitudinally extending first opening through which may extend said trolley connector projection, the first opening of the outer section being defined by opposed inwardly extending slot projections extending into the interior side of the outer sleeve section, each of the slot projections terminating in a respective first interior support surface, said inner section having a longitudinally extending second opening, the inner section having interior surface portions bordering the second opening on opposite sides thereof defining respective second interior support surfaces, the slot projections being adapted (or configured) to register within the second opening such that the first and second interior support surfaces are in an essentially common plane and define a travel support surface for the trolley component and wherein said mast component comprises at least two mast assemblies, each mast assembly having a longitudinal axis and comprising an outer section having an interior side and an exterior side, an inner section, said inner section being disposed on the interior side of said outer section so as to be telescopically displaceable in and out of said outer section along said longitudinal axis, and a releasable snap lock component comprising bias means a lock projection, a plurality of longitudinal spaced first lock openings defined by one of said inner and outer sections and a second lock opening defined by the other section, said outer section, said inner section, said bias means, said lock projection and said second opening being configured such that said second lock opening is aligned with said first lock openings and such that when said second lock opening is aligned with a first lock opening said lock projection is displaceable between a biassed lock position and an unlock position said bias means being configured so as to able to bias said lock projection in said biassed lock position said bias means being configured so as to able to bias said lock projection in said biassed lock position wherein when said lock projection is in said biassed lock position said lock projection is disposed in said second lock opening and in the first lock opening so as to inhibit telescopic displacement of said inner section along said longitudinal axis relative to said outer section, and wherein when said lock projection is in said unlock position said inner section is telescopically displaceable along the signal axis relative to said outer section.

In drawings which illustrate example embodiment of the present invention:

FIG. 1 illustrates in schematic form an example of a kit in accordance with the present invention which may be used to set up an overhead track system for a person handling system;

FIG. 2*a* is a schematic side view of a non-telescopic track or rail which may be used with a mast assembly in accordance with the present invention to make an overhead track system;

FIG. 2*b* is a schematic longitudinal or lengthwise cross sectional side view of the non-telescopic track or rail shown in FIG. 2*a;*

FIG. 3*a* is a schematic side view of an example telescopic track or rail of the present invention having three (3) parts or sections and which may, for example, be used with a mast assembly in accordance with the present invention to make an overhead track system;

FIG. 3*b* is a schematic longitudinal or lengthwise cross sectional side view of the telescopic track or rail shown in FIG. 3*a;*

FIG. 4*a* is a schematic side view of an example telescopic track or rail of the present invention having two (2) parts or sections and which may, for example, be used with a mast assembly in accordance with the present invention to make an overhead track system;

FIG. 4*b* is a schematic longitudinal or lengthwise cross sectional side view of the telescopic track or rail shown in FIG. 4*a;*

Figure 21:
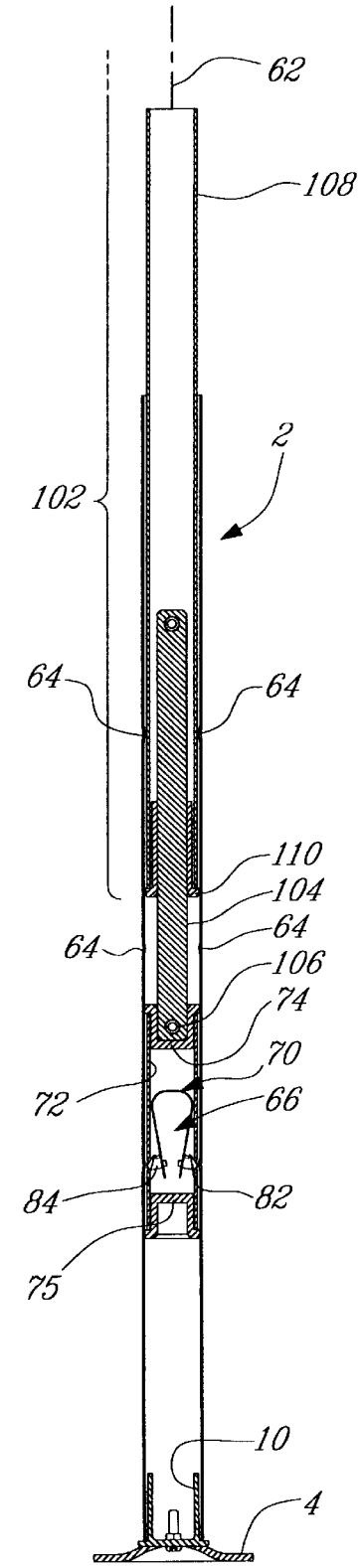
FIG. 21 is a partial cross-sectional side view of the mast assembly shown in FIG. 19 exposing an example extension component and base component of the inner telescopic section coupled together by a screw coupling and showing the lock projections of an example snap lock retaining member in an unlock position.
Figure 22:
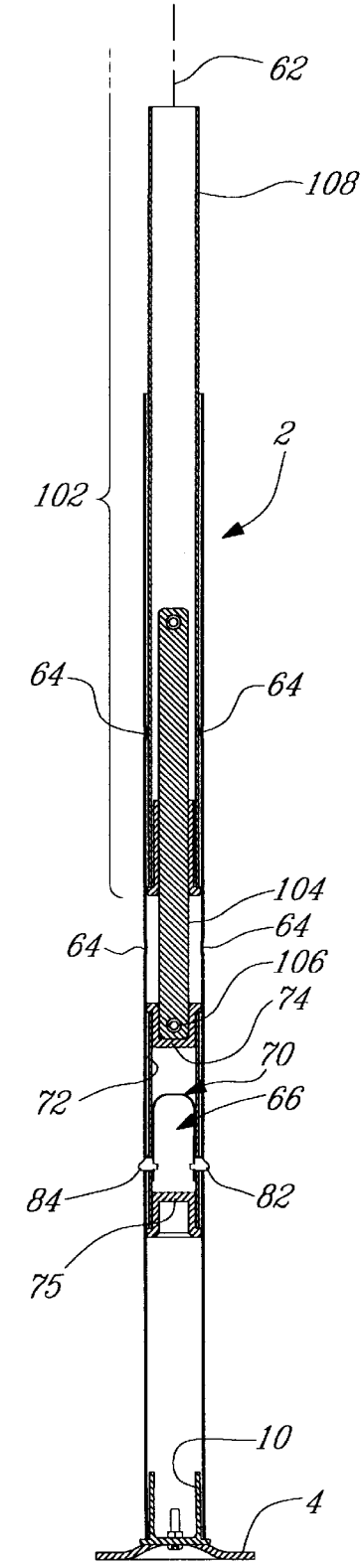
FIG. 22 is the same partial cross-sectional view shown in FIG. 21 except that the lock projections of the retaining member are in a lock position extending through respective first and second lock openings.
Figure 23:
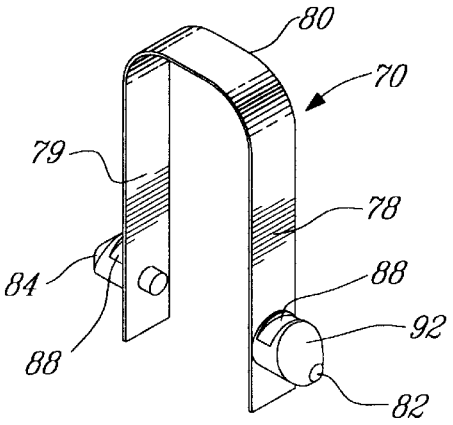
Figure 24:
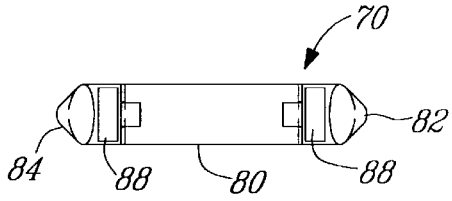
Figure 26:
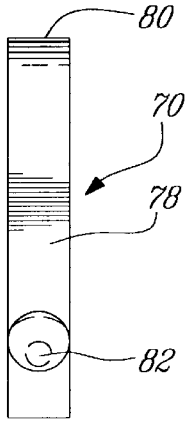
Figure 25:
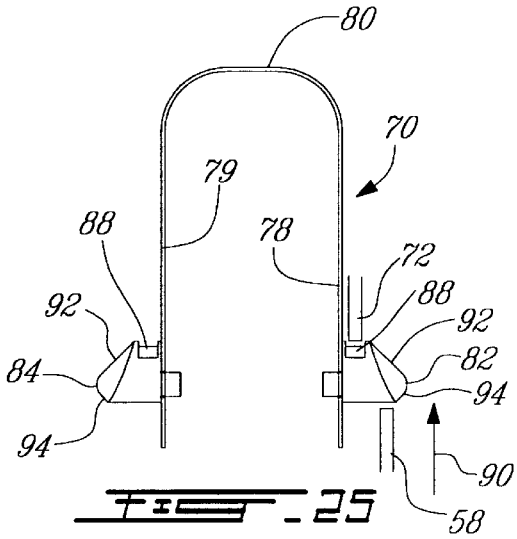
Figure 27:
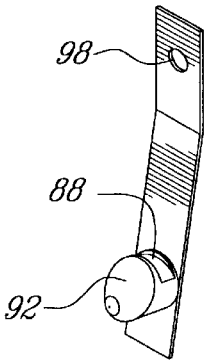

FIG. 23 shows in schematic perspective view an example U-shaped snap lock retaining member having a pair of spring arms for mounting in the lower end of the inner telescoping section for locking the upper and lower sections of the inner telescopic section together so as to inhibit longitudinal displacement of the of the inner telescopic section (and if desired as well as rotation of the lower component of the inner telescopic section);

FIG. 24 is a top view of the example retaining member shown in FIG. 23;

FIG. 25 is an edge side view of the retaining member shown in FIG. 23 with the lock projections being seen in side view;

FIG. 26 is another side view of the retaining member shown in FIG. 23 with a lock projection being seen end on;

FIG. 27 shows in schematic perspective view another example snap lock retaining member having a single spring arm;

FIG. 28 is a side view of the example base component and screw coupling of the inner telescopic section shown in FIGS. 21 and 22 and showing a lock projection end on extending through a second lock opening;

FIG. 29 is a side view of the example base component and screw coupling of the inner telescopic section shown in FIGS. 21 and 22 and showing in side view the lock projections of a snap lock retaining member extending through respective second lock openings;

FIG. 30 is a longitudinal cross sectional view of the elements shown in FIG. 29;

FIG. 31 is the same cross-sectional view shown in FIG. 30 but wherein the lock member comprises a single spring arm and lock projection as shown in FIG. 27

Figure 51:
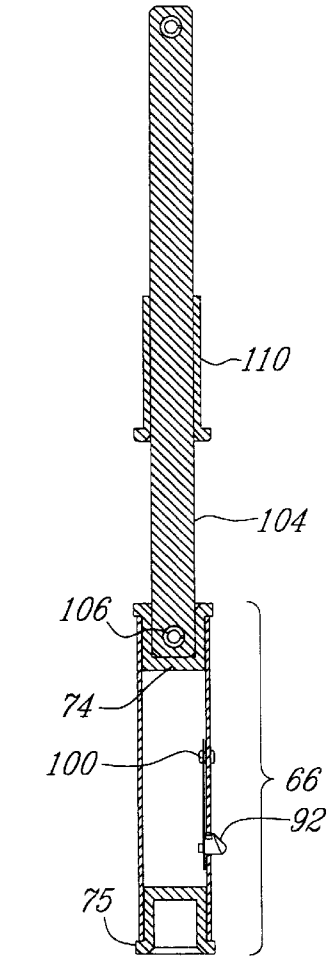
Figure 50:
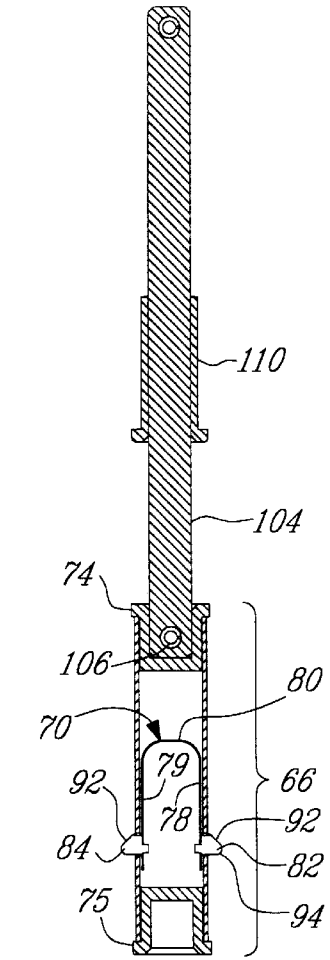
Figure 49:
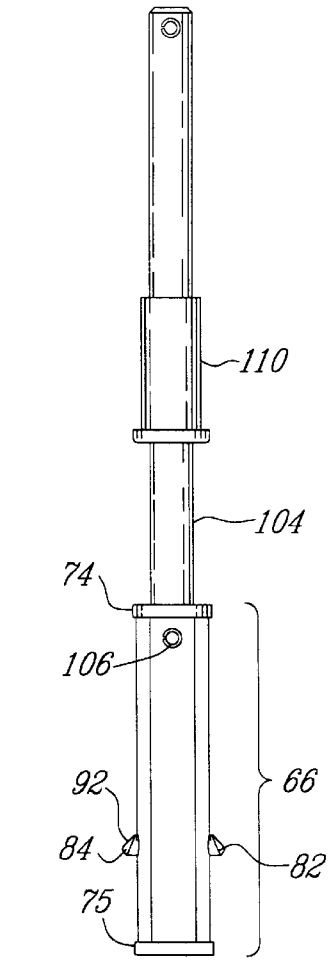
Figure 48:
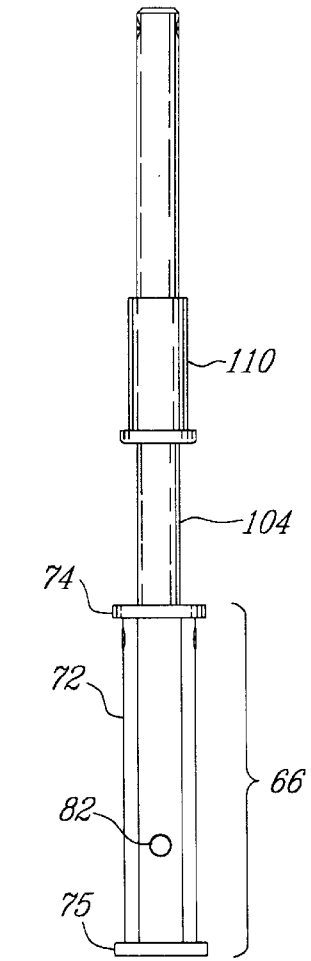
Figure 32:
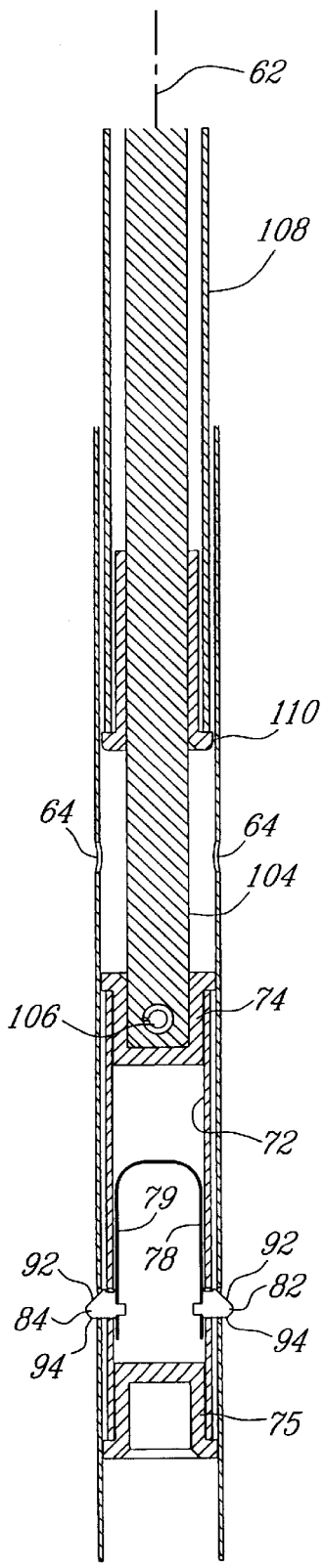
Figure 33:
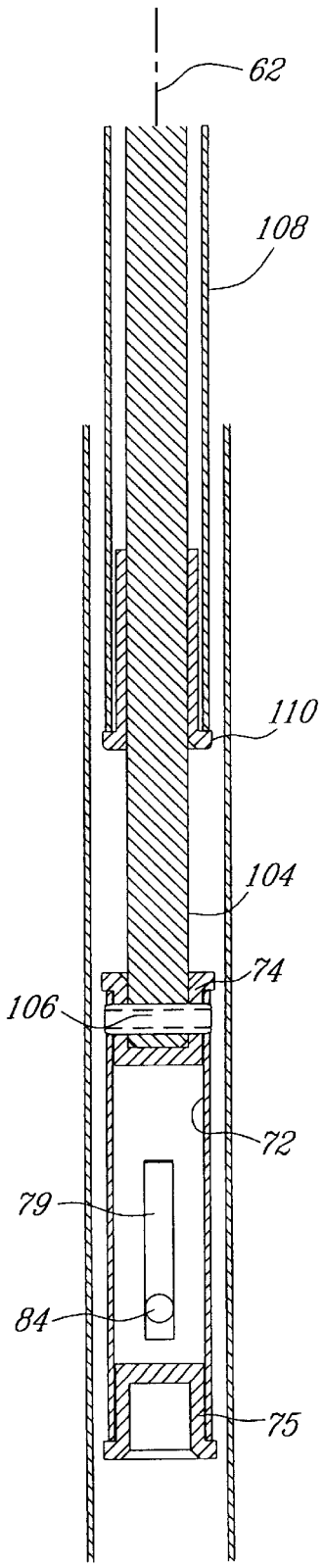
Figure 34:
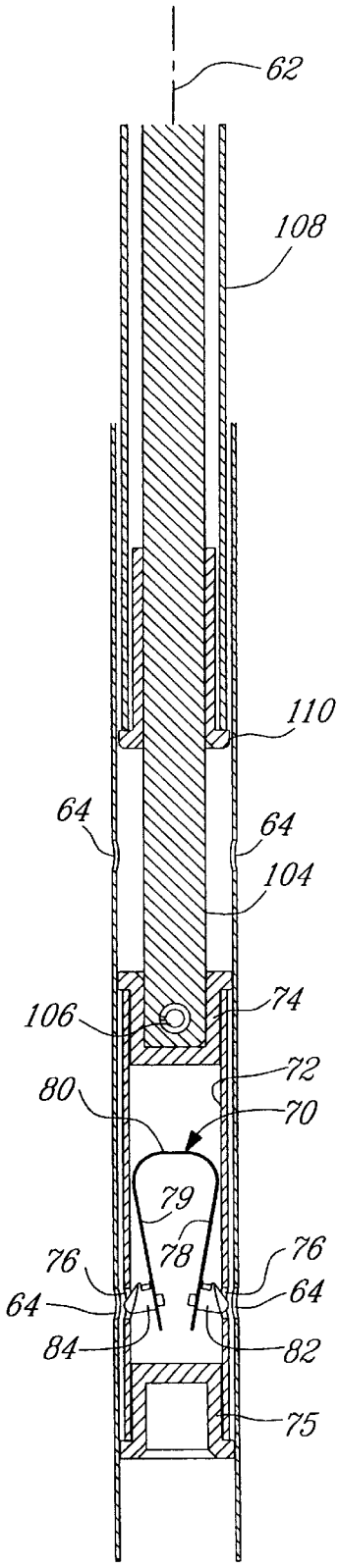
Figure 35:
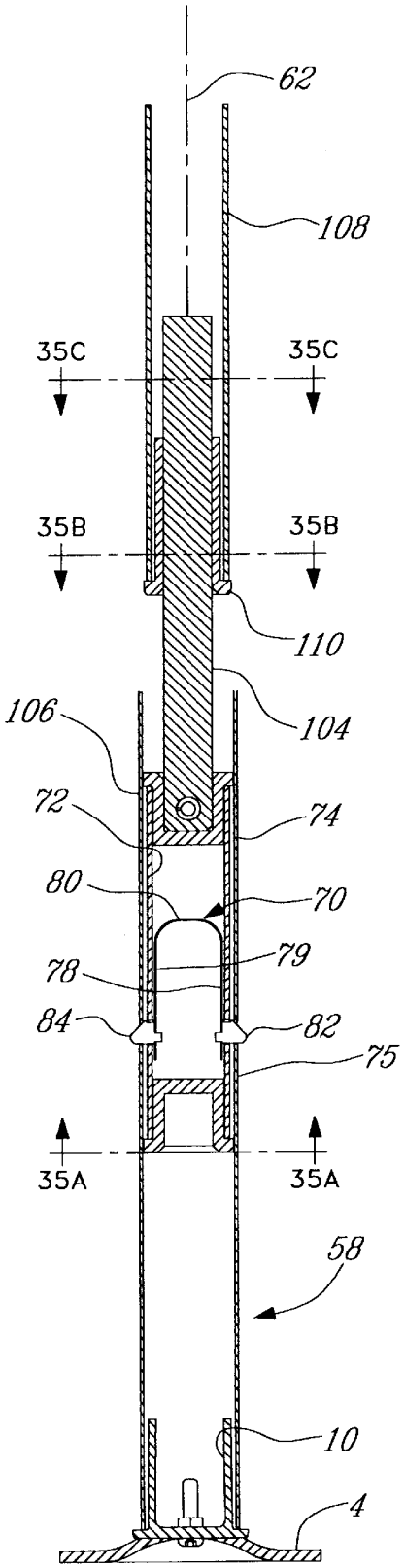
Figure 36:
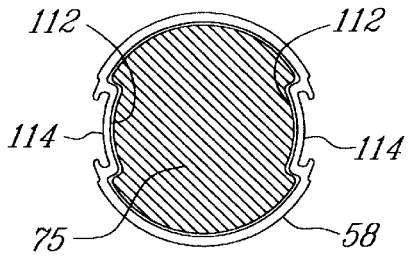
Figure 38:
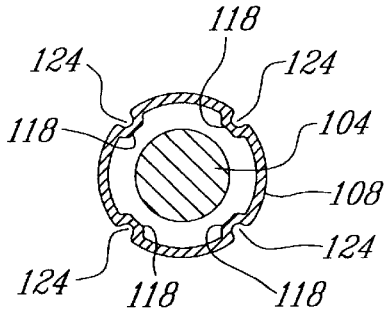
Figure 39:
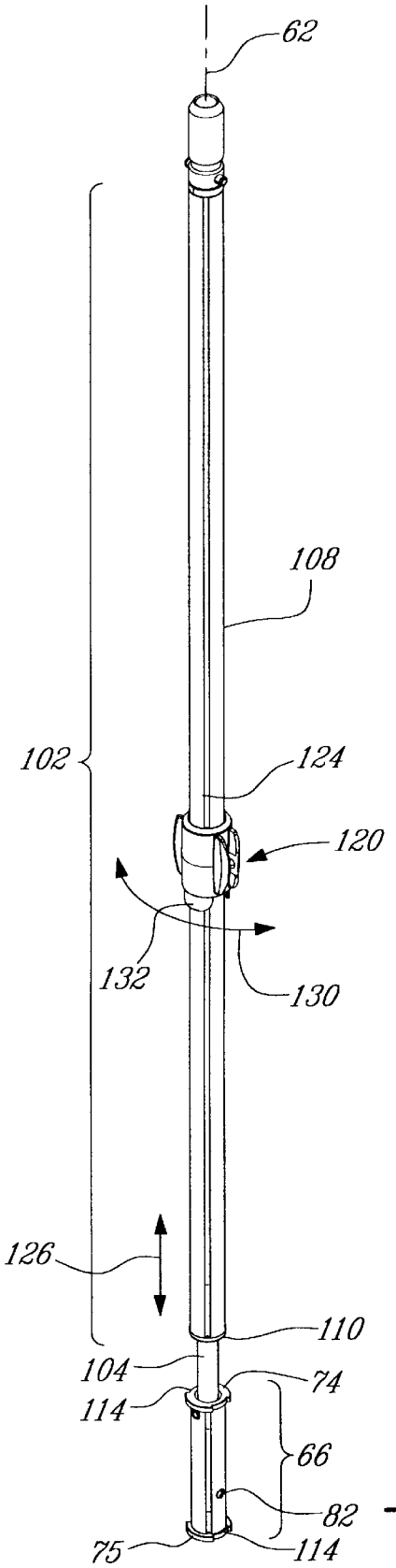
Figure 40:
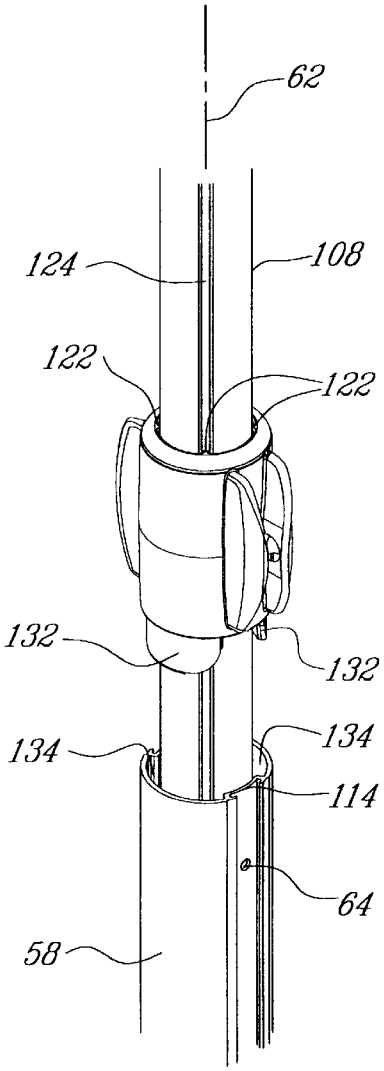
Figure 41:
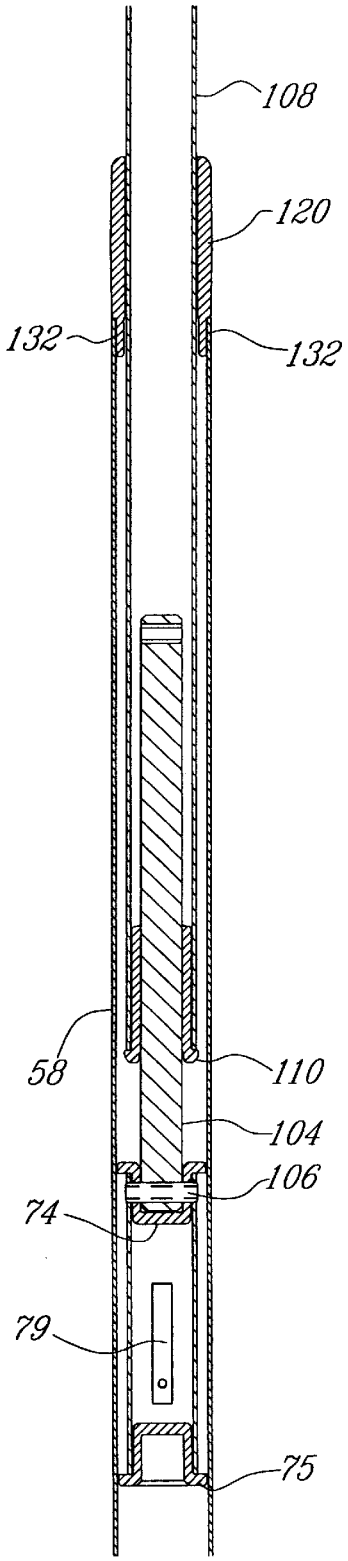
Figure 42:
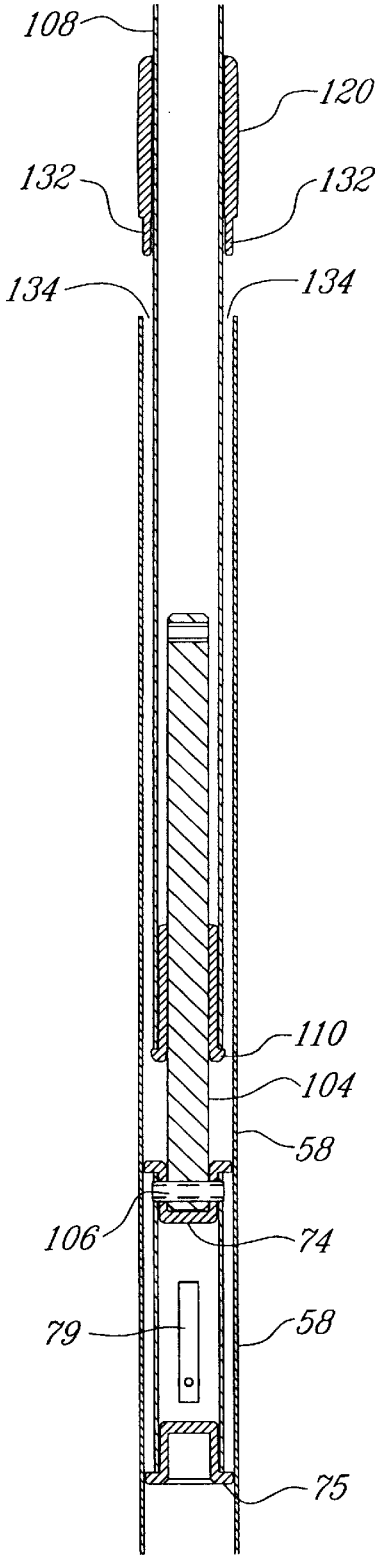
Figure 44:
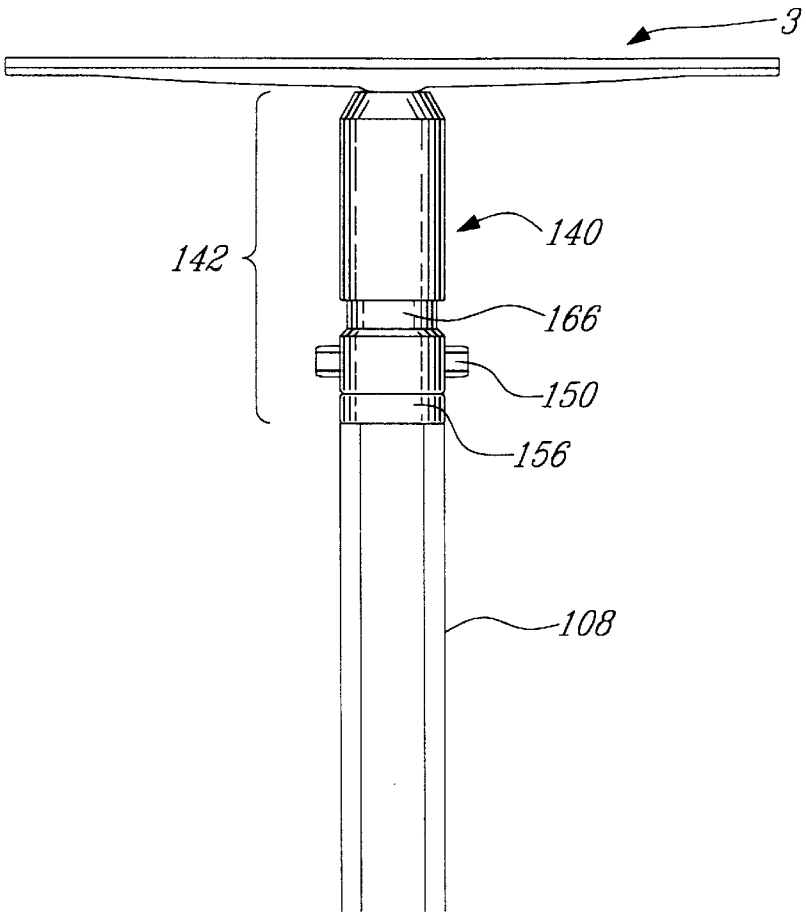
Figure 43:
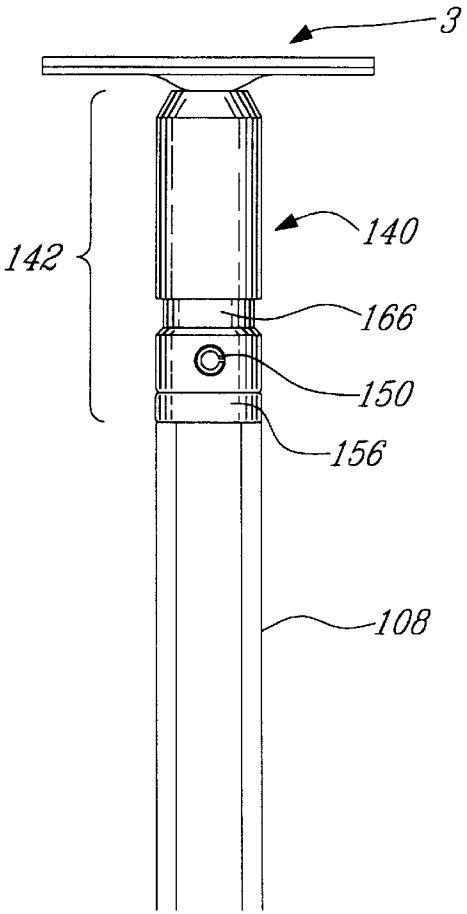
Figure 47:
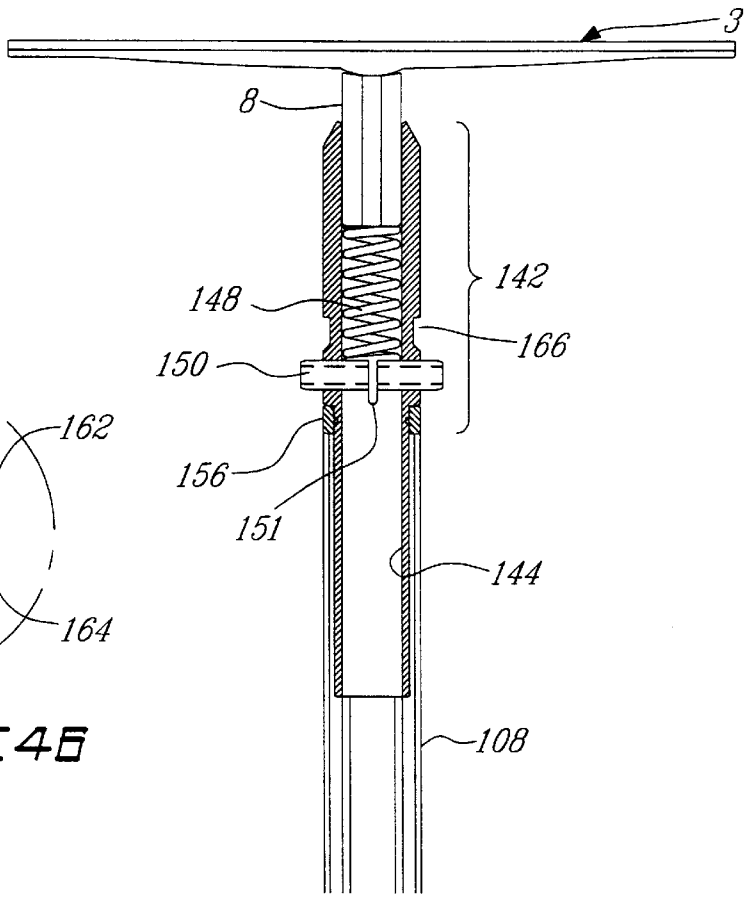
Figure 46:
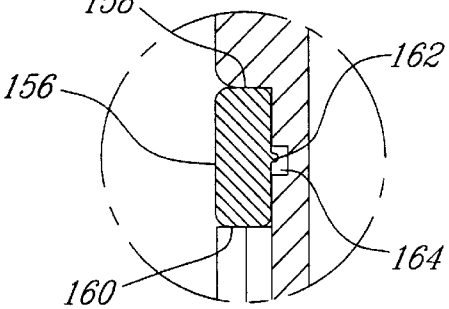
Figure 45:
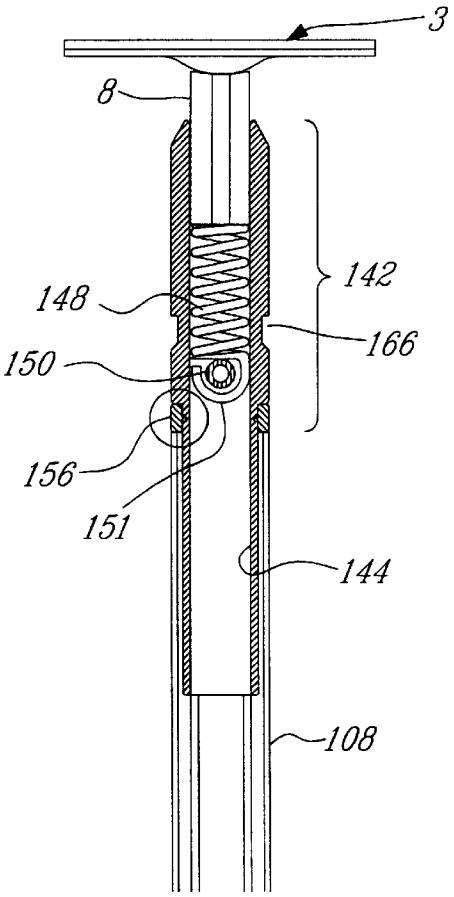
Figure 53:
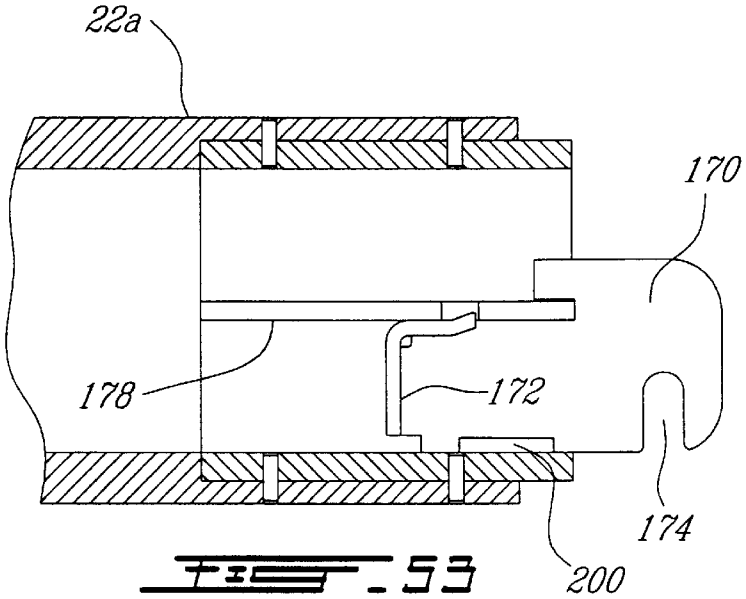
Figure 52:
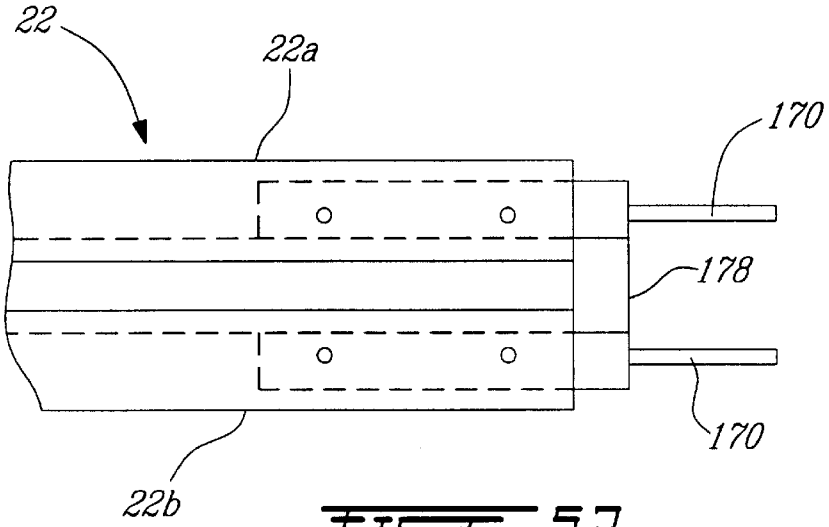
Figures 54, 55:
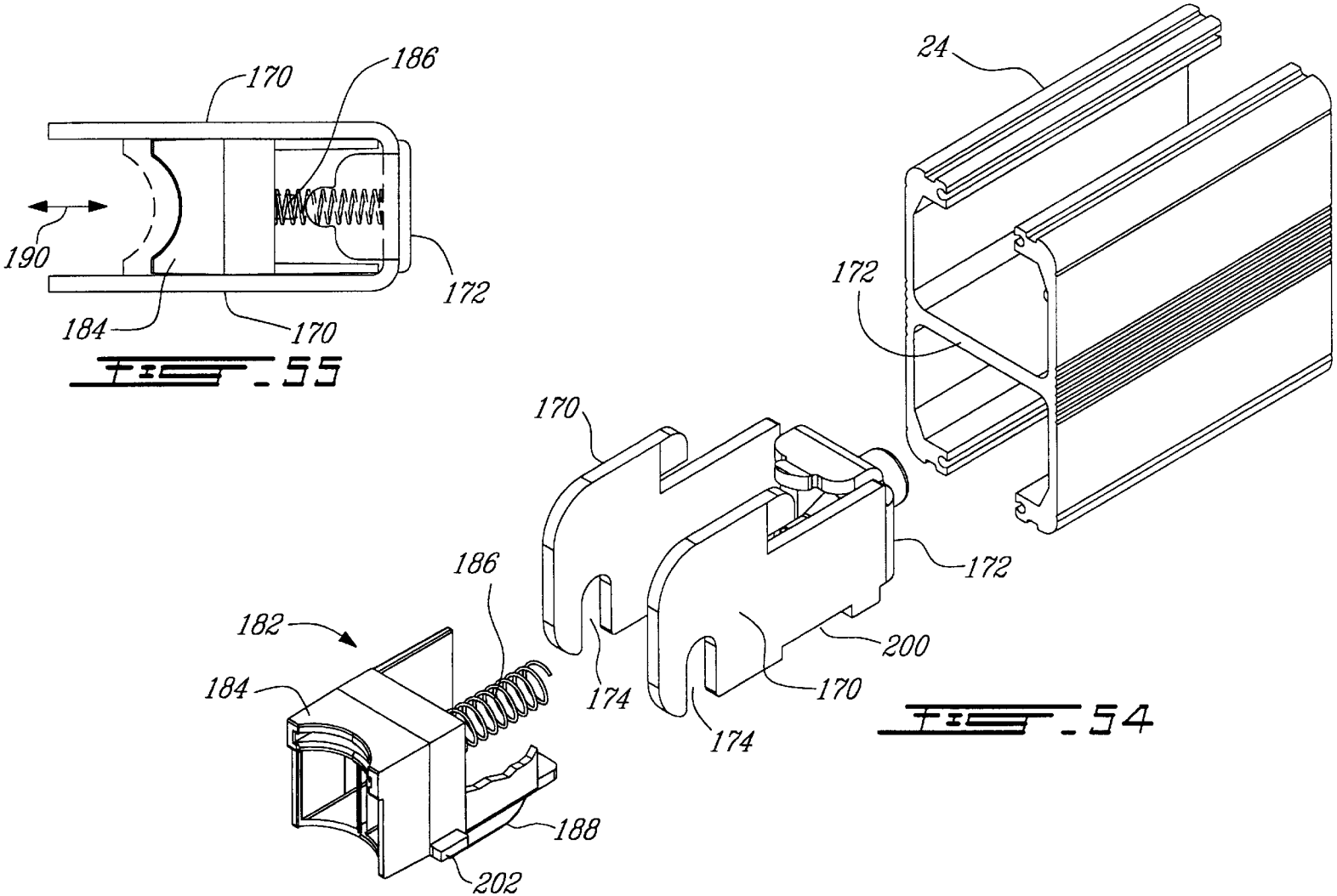
Figure 57:
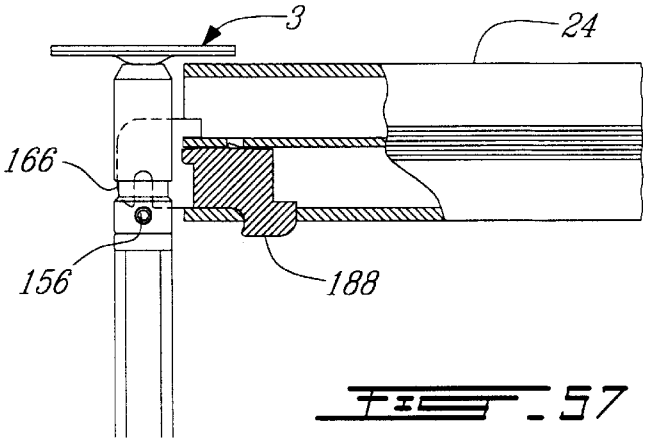
Figure 58:
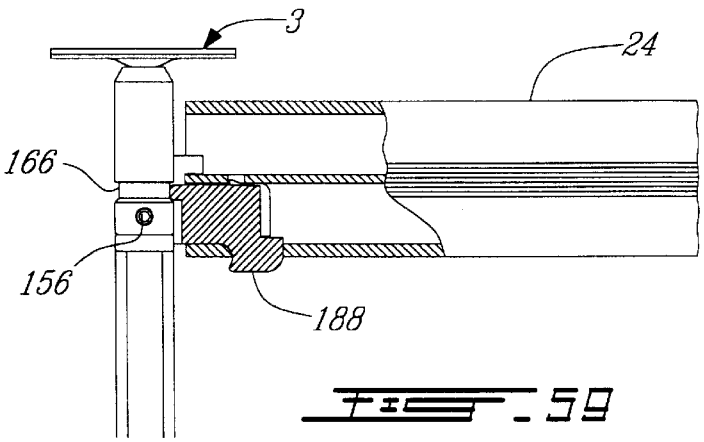
Figure 59:
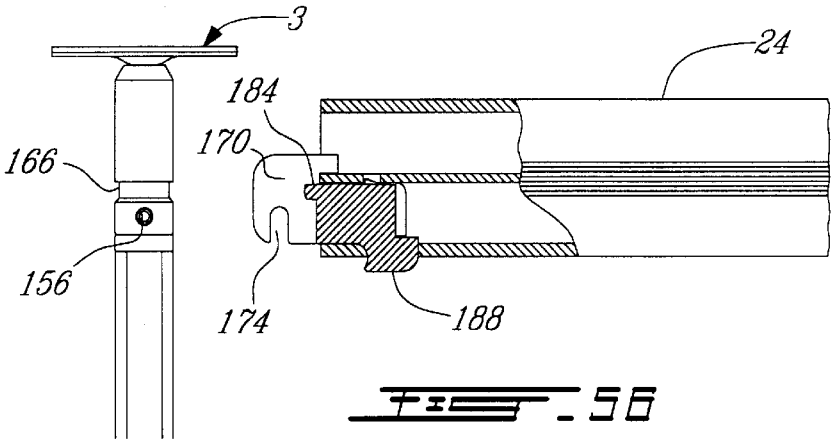
Figure 60:
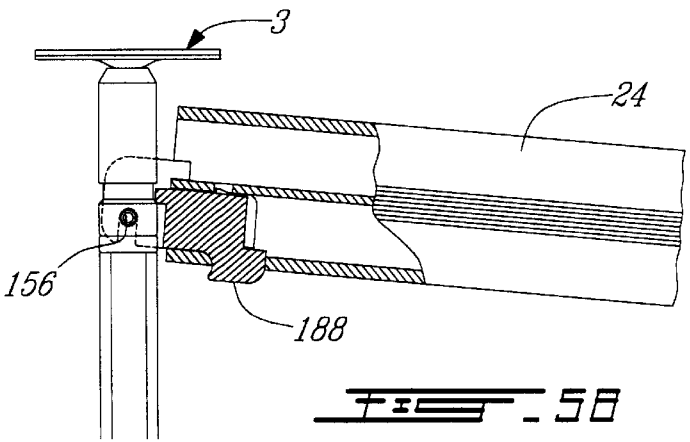
Figure 60:
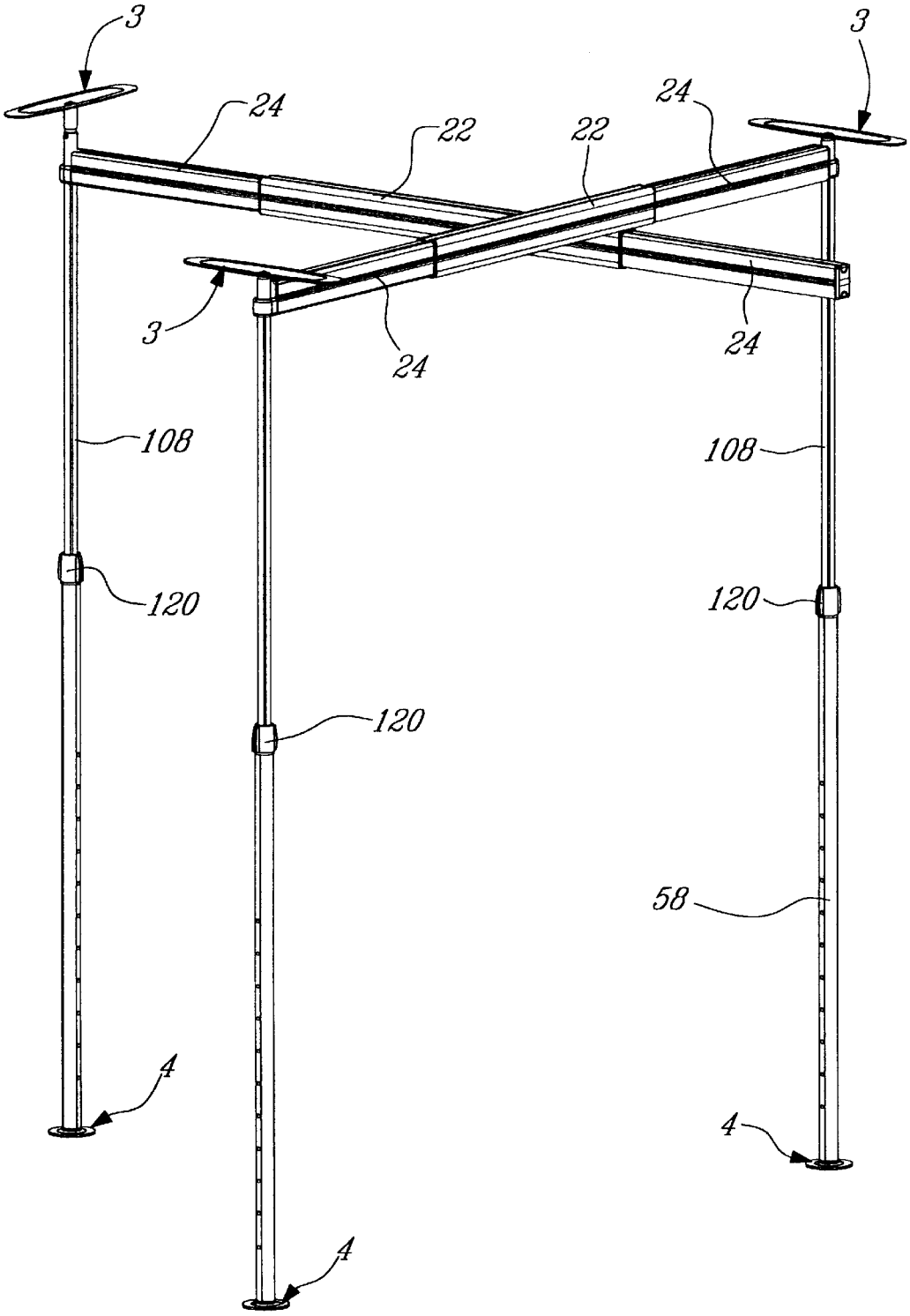
Figure 61:
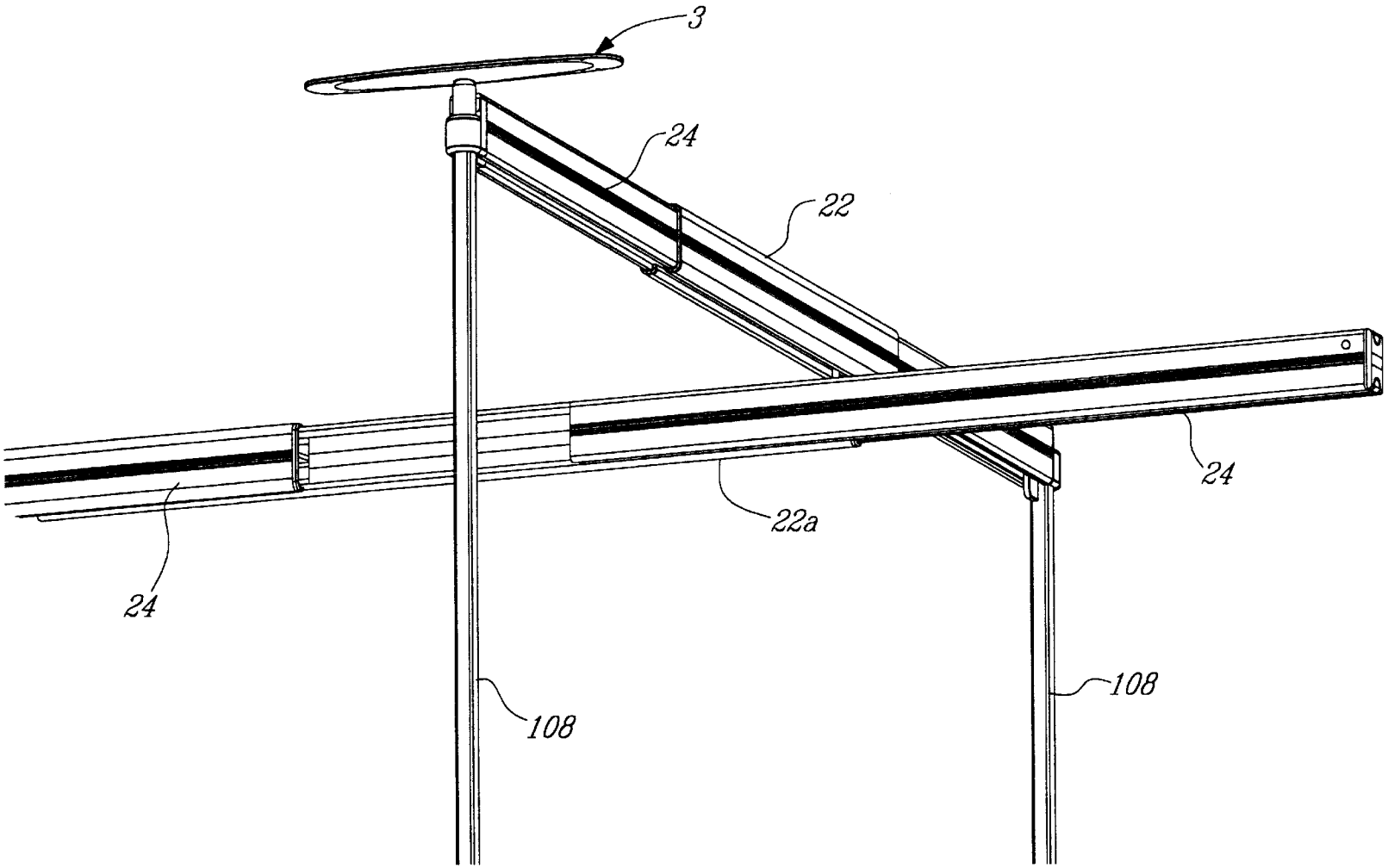
Figure 62:
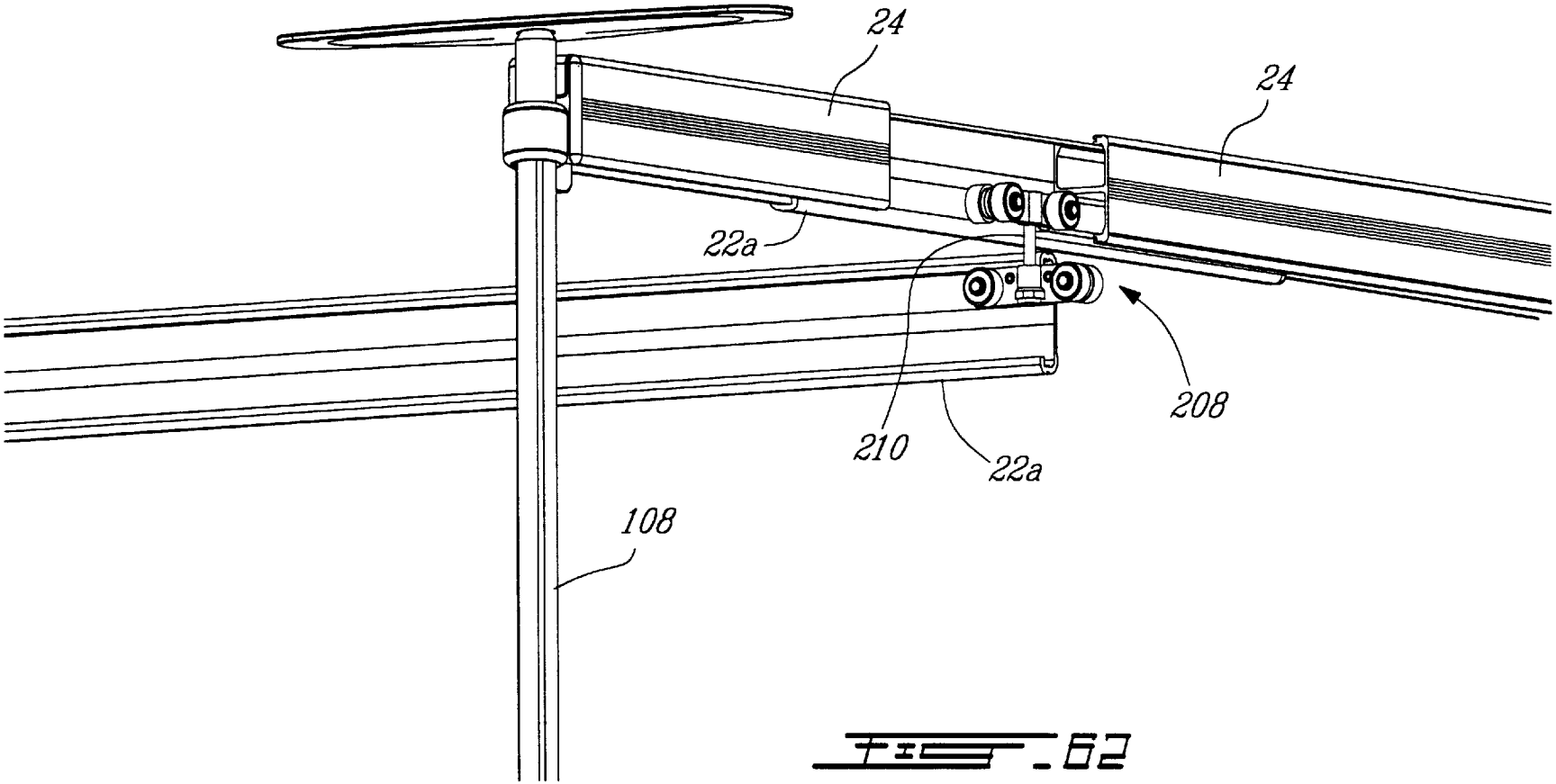

FIG. 32 is an enlarged partial longitudinal cross sectional view of the mast assembly as shown in FIG. 22 showing the extension component and the base component of the inner telescopic section disposed in the outer sleeve tubular section with the lock projections in lock position, namely being disposed in respective pairs of first and second lock openings;

FIG. 33 is a enlarged partial longitudinal cross sectional view of the mast assembly as shown in FIG. 22 showing the extension component and the base component of the inner telescopic section disposed in the outer sleeve tubular section with a lock projection being shown end on;

FIG. 34 is the same view as shown in FIG. 32 but wherein the lock projections have been displaced inwardly to a non-lock position as shown in FIG. 21;

FIG. 35 is a further enlarged partial longitudinal cross sectional view of the mast assembly as shown in FIG. 22 showing the extension component and the base component of the inner telescopic section disposed in the outer sleeve tubular section with only a lower part of the outer sleeve being shown;

FIG. 36 is a cross sectional view along 35A—35A of the elements shown in FIG. 35;

FIG. 37is a cross sectional view along 35B—35B of the elements shown in FIG. 35;

FIG. 38 is a cross sectional view along 35C—35C of the elements shown in FIG. 35;

FIG. 39 is a perspective view of the entire inner section of the mast assembly (shown in partial view in FIG. 19) but without the outer sleeve section;

FIG. 40 is an enlarge partial perspective view of the inner section of FIG. 39 projecting from the outer sleeve section along with an example rotational handle;

FIG. 41 is a partial longitudinal cross sectional view showing the inner section telescoping out of the outer section with the rotational handle of FIG. 40 in rotational lock position;

FIG. 42 is a partial longitudinal cross sectional view showing the inner section telescoping out of the outer section with the rotational handle of FIG. 40 in a free position for urging the inner section to rotate about the longitudinal axis of the mast component;

FIG. 43 is a schematic side view of the upper end of the mast assembly provided with an example load spreader member held in place by an intermediate engagement member fixed to the end of the inner section by a fixing pin seen end on;

FIG. 44 is a further schematic side view of the upper end of the mast component shown in FIG. 43 showing the broad side edge of the load spreader member, the ends of the fixing pin being seen in side view projecting out of the intermediate engagement member;

FIG. 45 is the same view as seen in FIG. 43 but with the side wall of the inner section and the intermediate engagement member being cut away to expose the biassing or compression spring in uncompressed configuration;

FIG. 46 is an enlarged portion of the annular bearing element or collar disposed between the intermediate engagement member and the respective inner section to facilitate rotation of the inner section relative to the intermediate engagement member;

FIG. 47 is the same view as seen in FIG. 44 but with the side wall of the inner section and the intermediate engagement member being cut away to expose the biassing or compression spring in uncompressed configuration;

FIG. 48 is the same view as seen in FIG. 43 but with the side wall of the inner section and the intermediate engagement member being cut away to expose the blassing compression spring in compressed configuration;

FIG. 49 is the same view as seen in FIG. 44 but with the side wall of the inner section and the intermediate engagement member being cut away to expose the blassing or compression spring in compressed configuration;

FIG. 50 is a partial perspective view of an example track coupling element of the present invention for releasably coupling the end of a rail or track to a mast;

FIG. 51 is a partial upper perspective view of the coupled mast and track as shown in FIG. 50;

FIG. 52 is a top view of an end of an example outer sleeve track section comprising a pair of wing elements fixed together and to the track coupling element;

FIG. 53 is a longitudinal cross sectional view of the rail end shown in FIG. 52;

FIG. 54 is an exploded side perspective view of an end of an inner section, track coupling element and a releasable quick lock mast coupling element for being fixed to this end;

FIG. 55 is a top view of the mast coupling element of FIG. 54 the releasable mast lock element in an unlock position and a biassed lock position, the biassed lock position being shown in dotted outline;

FIG. 56 is a schematic side view of the ends of the mast and track in the process of being coupled by the releasable mast coupling element and the track coupling element, the outer wall of the end of the track being shown in partial cut away;

FIG. 57 is a schematic side view of the ends of the mast and rail shown in FIG. 56 in the process of being coupled by the releasable mast coupling element and the track coupling element, with the U-shaped lock channel of the track coupling element being positioned so as to engage the lock pin element of the intermediate engagement member;

FIG. 58 is a schematic side view of the ends of the mast and track shown in FIG. 56 with the intermediate engagement member lock pin engaged in the lock channel of the track coupling element;

FIG. 59 is a schematic side view of the ends of the mast and track shown in FIG. 56 with the track lock projection engaged in the annular lock channel of the intermediate engagement member for preventing or inhibiting movement of the end of the track from the locked in configuration;

FIG. 60 illustrates an alternate embodiment of an overhead rail system which may be made in accordance with the present invention exploiting three mast components and two overhead rail components;

FIG. 61 is an enlarged partial perspective illustration showing the junction of the two overhead rail components illustrated in FIG. 60; and FIG. 62 is a enlarged view of the junction of the overhead rail components in FIG. 61 with the portions of the overhead rail components not being shown so as to expose the trolley connection mechanisms for attaching the lower overhead rail component to the upper overhead rail component.

Figure 1:
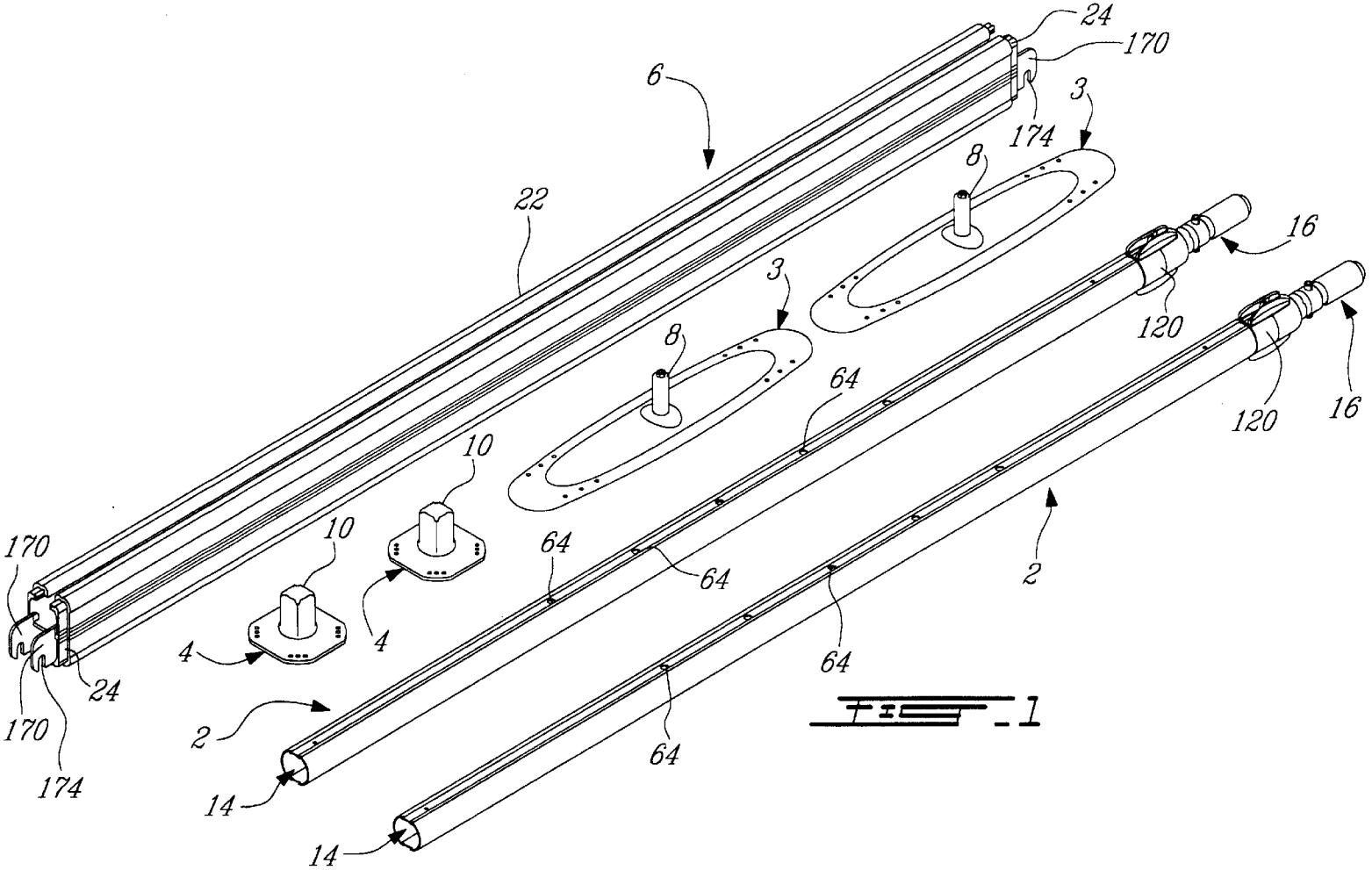

Referring to FIG. 1, this figure illustrates an example kit for the construction of a rebuildable (i.e. knock down) overhead rail system of the present invention (i.e. a system which may be relatively easily erected and dismantled as desired).

The kit shown in FIG. 1 comprises a) two mast assemblies 2 of telescopically variable length, b) two upper load spreader plate elements 3 releasably engageable with the upper ends of the mast assemblies 2 for engaging and distributing the load applied by a respective mast assembly 2 to an upper support surface (e.g. ceiling surface) over a relatively large surface area, c) two lower pedestal plate elements 4 releaseably engageable with the lower ends of the mast assemblies 2 for engaging and distributing the load applied by a respective mast to a lower support surface (e.g. floor surface) over a relatively large surface area, and d) a three part or section telescopic track 6 of telescopically variable length.

The plate elements 3 and 4 may as desired or necessary comprise a friction pad element to provide an enhanced gripping action on the part of a plate with respect to the respective surface against which the plate is to act against when a mast assembly 2 is in an installed upright position pressing against both the upper (ceiling) support surface and the lower (floor) support surface. The plate elements 3 and 4 each have respective projections 8 and 10 for engagement thereof to respective ends of a mast assembly 2 by slidable engagement in a sleeve element defined at respective ends of the mast assembly; the opening for the sleeve element for a pedestal plate element 4 is designated by the reference numeral 14.

In the following reference will be made to an upper (i.e. ceiling) surface and a lower (i.e. floor) surface in relation to the figures; however for illustration purposes these surfaces are not shown in relation to figures showing upstanding mast assembly(ies) but are to be understood as being present where required.

The mast assemblies 2 may have an inner section which comprises an extension component and a base component which are screw coupled together such that rotation of the extension component, once the base component is locked in place by a (snap lock) retaining member, can cause or induce the extension component to travel upwardly (or downwardly) towards (or away from) an upper support surface (e.g. the ceiling) so as to increase (or decrease) the pressure exerted by the mast assembly between the upper and lower support surfaces.

The two upper load spreader plate elements 2 may be each be connected to the upper end of a respective extension component of an inner section by a removeable intermediate connector element 16 comprising a compression spring acting between the upper end of the inner section and a respective load spreader plate 2; the compression of the spring being varied by the relative longitudinal displacement of the extension component of the inner section along the longitudinal axis of the mast assembly 2.

Figures 2A, 2B, 3A, 3B, 4A, 4B:
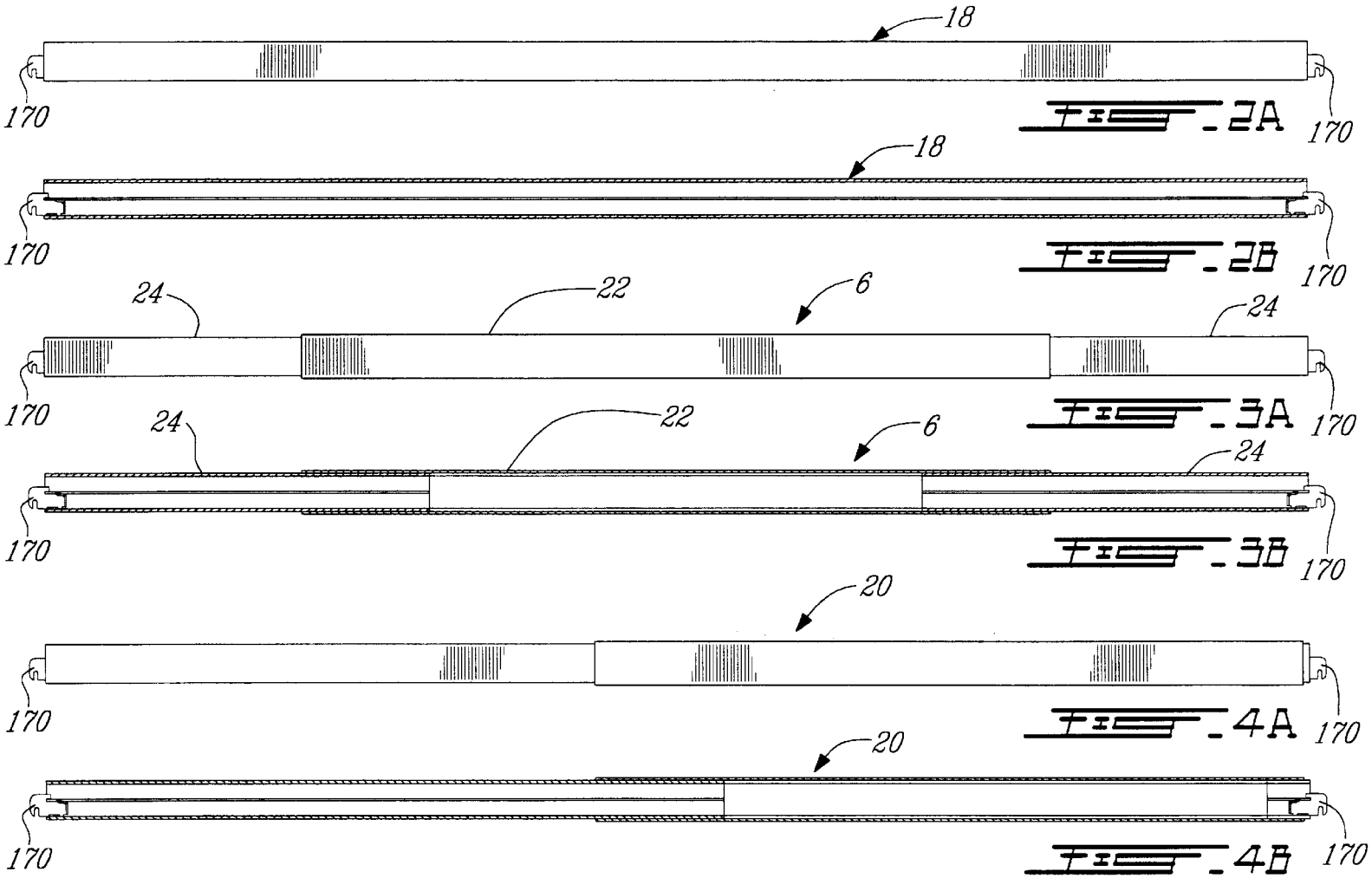
Figure 5:
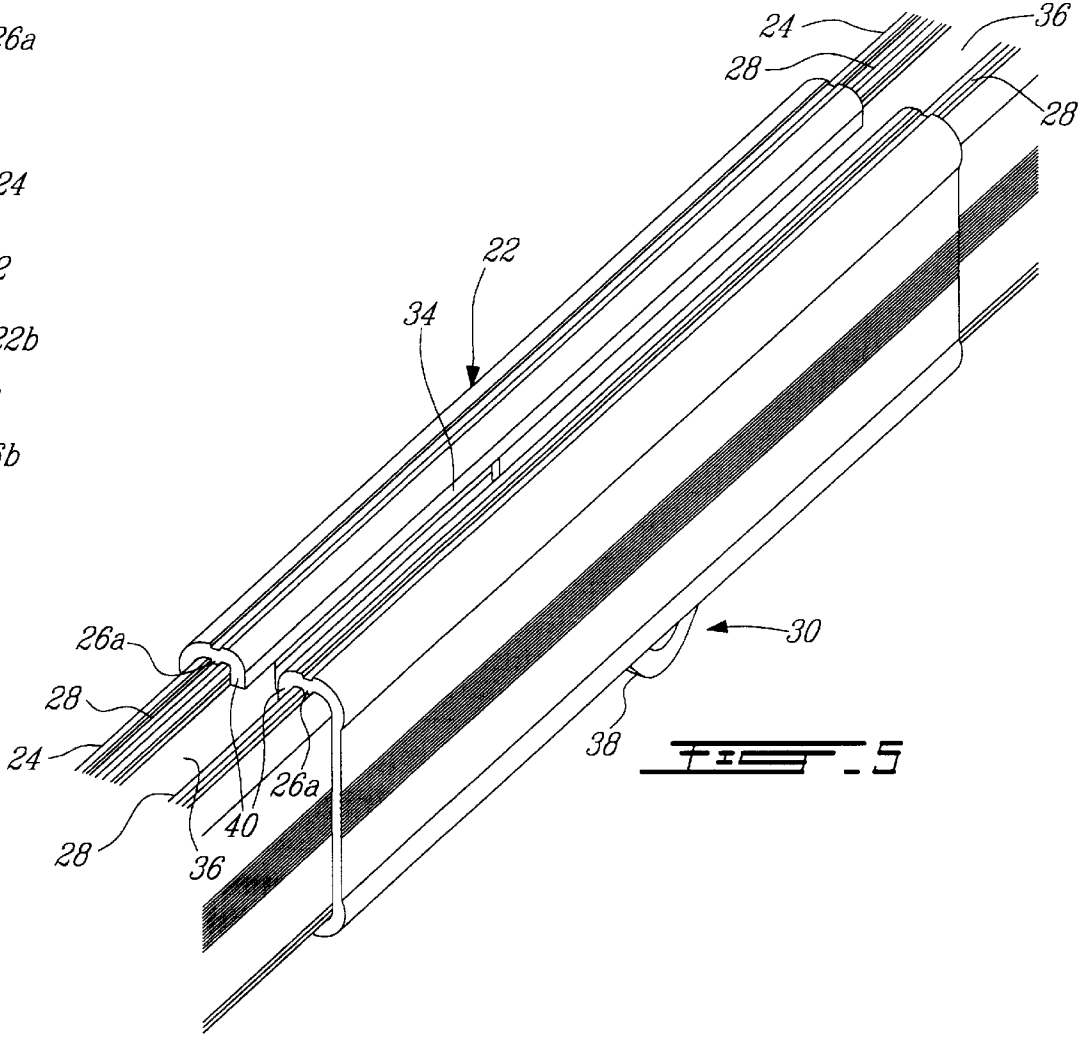
FIG. 5 is a partial enlarged perspective view highlighting the central portion of the three part or section overhead track component as shown in FIGS. 3*a* and 3*b;*

FIGS. 2*a* to 4*b* illustrate three example types of tracks for an overhead rail system in accordance with the present invention. FIGS. 2*a* and 2*b* illustrate a single or unitary track 18 of invariable length. FIGS. 3*a* and 3*b* illustrate the three part or section telescopic track 6 in accordance with the present invention of telescopically variable length. FIGS. 4*a* and 4*b* illustrate a two part or section telescopic track 20 in accordance with the present invention also of telescopically variable length. The track 6 shown in FIG. 1 is, as mentioned, of the three section telescopic type.

As shall be discussed herein below, more particularly with respect to a three part track 6, a telescopic track of the present invention whether comprised of two or more parts, has a trolley travel support surface which defines a common plane, i.e. there is no stepped interruption in the travel support surface upon which a trolley component might get jammed. Each of the parts or sections of a telescopic track of the present invention partly defines the overall support surface which is in a common plane. Thus as shall be seen below since there is no stepped interruption in the travel support surface a trolley component is able to freely travel the length of the track even when when passing to or from a support surface portion defined by only one of the track sections or parts.

Referring to FIGS. 3*a* and 3*b*, as mentioned the telescopic track 6 shown in FIG. 1 comprises three elements or sections namely, a central outer section 22 and two inner sections 24 extending from the central section 22. The inner sections 24 engage the central section 22 in telescopic fashion such that they may (independently) be extended and retracted in telescopic fashion relative to the central section 22, i.e. an inner section 24 is disposed (coaxially) on the interior side of the outer section 22 so as to be telescopically displaceable out and into the central outer section 22. In effect the central section 22 couples the two inner sections 24 together in telescopic relationship, i.e. when the inner sections 24 are disposed so as to be spaced apart, the spaced apart inner sections 24 are coupled together by the central section 22.

Referring to FIGS. 5 to 11, the two inner sections 24 have a more or less H-like cross sectional shape. On the other hand, the central section 22 is comprised of two separate outer wing members 22*a* and 22*b* of elongated C-shaped cross sectional configuration. The wing members 22*a* and 22*b* each have a pair of projections 26*a* and 26*b* which register in corresponding guide channels 28 defined by respective opposed sides of each of the inner sections 24. The wing members 22*a* and 22*b* thus engage each of the inner sections 24 in sliding fashion to allow for the aforesaid telescopic displacement of the inner sections 24 relative to the central section 22.

As may be seen from FIGS. 5 to 9, the track defines two tubular travel channels having a tunnel like aspect. A trolley component 30 is disposed in one of the travel channels. The trolley component 30 has wheels 32 which roll along an essentially planar support surface which may be defined by the central section wings 22*a* and 22*b* and an inner section 24 together or only by the central section wings 22*a* and 22*b* or only by an inner section 24. The central section 22 comprises two longitudinally extending slots 34 and the inner sections 24 comprises two longitudinally extending slots 36. A trolley connector projection 38 may extend through slots 34 and 36 such as is shown in FIGS. 6, 8, 9 and 62 for example. The trolley component connector projection 38 is configured in any (known) suitable manner to be able to connect the trolley to a winch or other type system for the purpose of assisting in the displacement of a person such as a patient from one position to another by displacing the trolley from one position to another.

Figure 10:
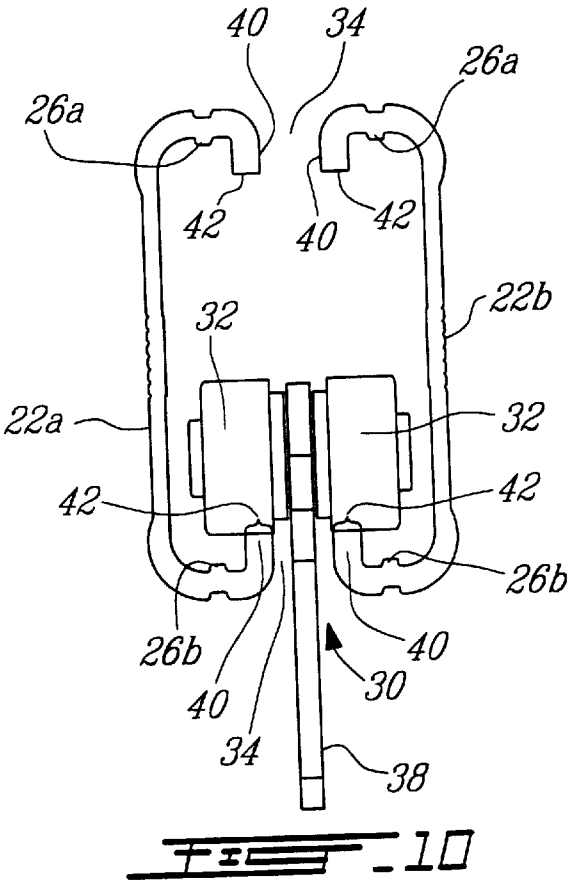
FIG. 10 is a cross section view of the outer section shown in FIG. 9.
Figure 9:
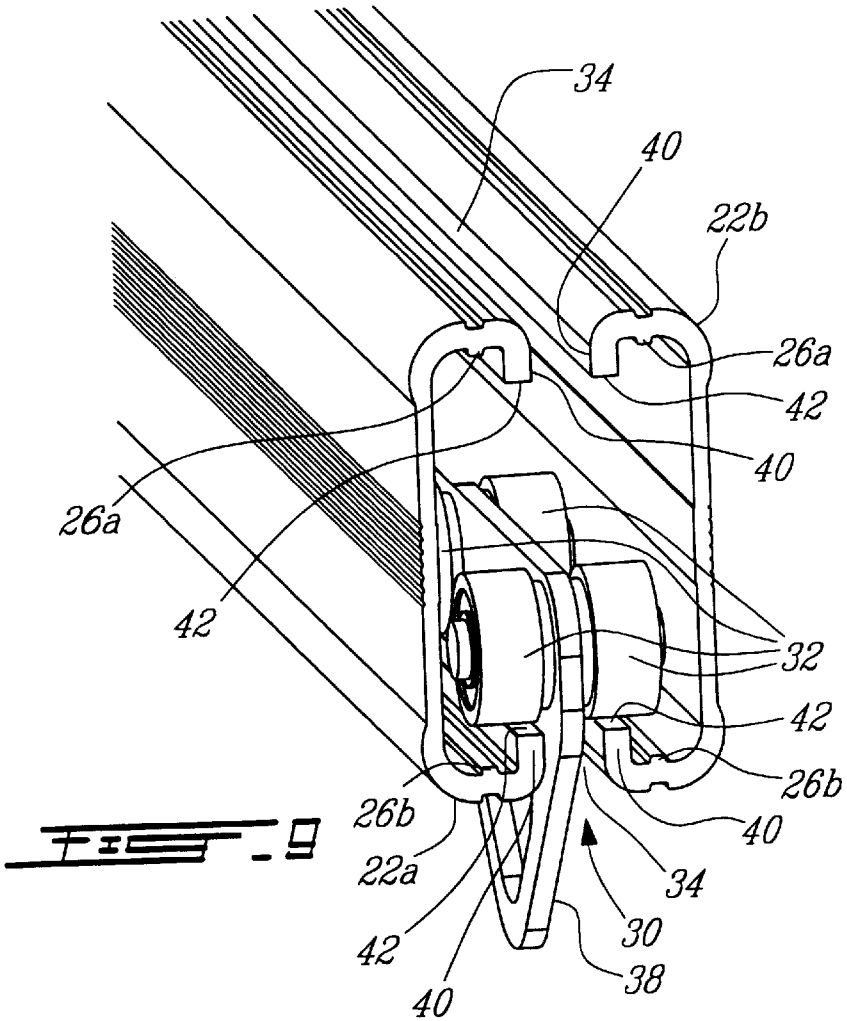
FIG. 9 is a partial enlarged perspective illustration of the outer section of the three part track or rail component as shown in FIGS. 3*a* and 3*b* in the area wherein only the outer section defines the travel path for the trolley component.

The outer wings 22*a* and 22*b* of the central section 22 each have inwardly extending projections 40 which define the respective longitudinally extending slots 34 thereof, i.e. these projections 40 extend into the interior of the section 22. These projections 40 each terminate in a travel surface 42 along which trolley component 30 may travel. FIGS. 9 and 10 show a portion of the central section 22 which does not include the inner rail sections 24, i.e. the opposite ends of the inner rail sections 22 are spaced apart.

Figure 11:
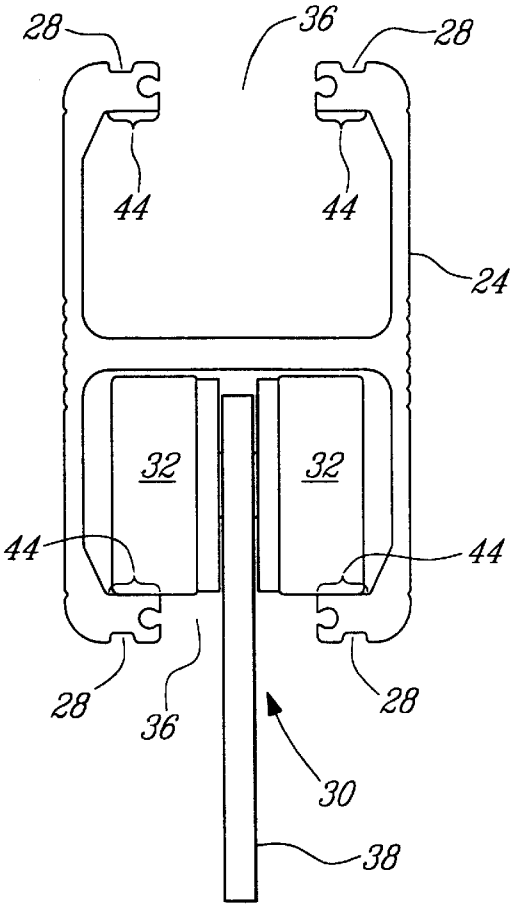
FIG. 11 is cross section view of an inner section of the three part track or rail component as shown in FIGS. 3*a* and 3*b* in the area wherein only the inner section defines the travel path for the trolley component.

On the other hand, as may be seen (see FIGS. 7 and 11), the inner sections 24 have surface portions adjacent to or bordering their respective slots which likewise define travel surfaces 44 along which the trolley component may travel. FIG. 11 shows a portion of an inner section 24 which does not include the central outer track or rail section 22, i.e. the part of the inner track or rail section 24 shown is spaced apart from the central section 22.

Figure 6:
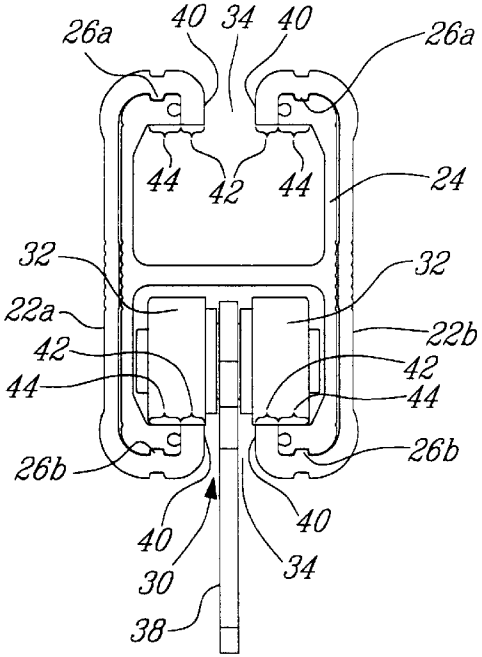
FIG. 6 is a cross sectional view of the central track portion shown in FIG. 5, including a trolley element or component, and wherein both the outer section and sinner section define the travel path for the trolley component.
Figure 7:
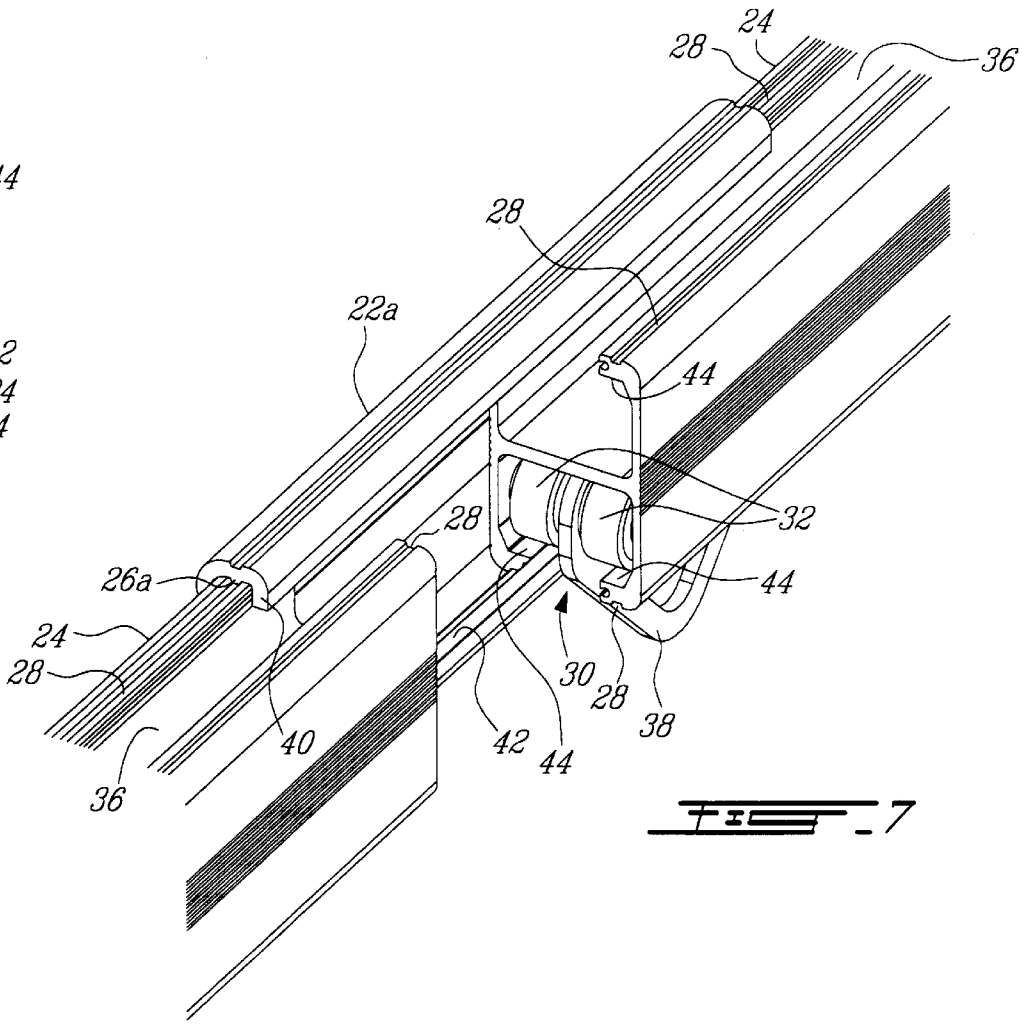
FIG. 7 is the same view as shown in FIG. 5 but wherein one of the side wing members of the outer track section is removed so as to expose the trolley component and the spaced apart ends of the two inner sections of the track.
Figure 8:
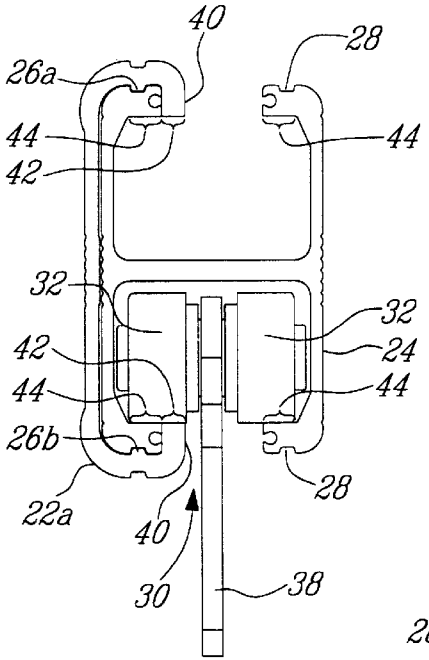
FIG. 8 is the same view as shown in FIG. 6 but wherein one of the side wing members of the outer track section is removed.

As may be appreciated from FIG. 6, 7, and 8 for those portions of the travel channel defined by both the outer section 22 and inner sections 24, the portion of the travel channel defined only by an inner section 24 and the portion of a travel channel defined only by central section 22, the travel surfaces are all in a common plane with no stepped interruptions.

Accordingly, the trolley component 30 may travel on its wheels 32 from one end of an inner section 24 through the central outer section 22 and on into the other inner section 24 along a travel surface which is essentially in a common plane, the common plane being defined by a travel surface 44 of an inner section 24 alone, by a travel surface 42 of a central outer section 22 alone or by the travel surfaces the inner and outer sections defined together, i.e. a combined travel surface comprising travel surfaces 42 and 44. In this manner, a smooth travel of the trolley component 30 from one end of the travel channel to the other is assured. In other words, there is no step transition as the trolley component 30 passes into or out of the central portion 22 of the telescopic track 6 which partially defines the travel channel.

Figure 13:
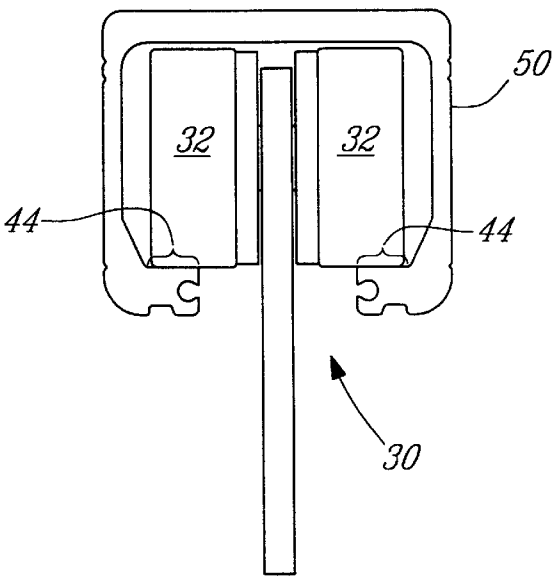
FIG. 13 is cross section view of an inner section of the alternate track as shown in FIG. 12 in the area wherein only the inner section defines the travel path for the trolley component.
Figure 12:
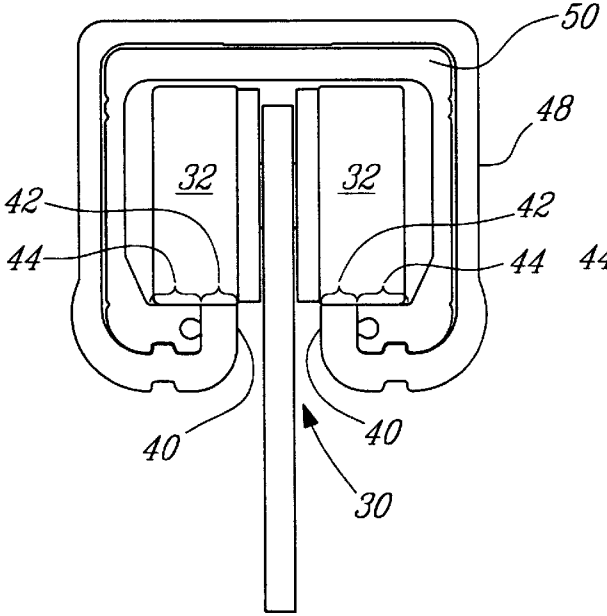
FIG. 12 is an cross sectional view similar to that shown in FIG. 6 of an alternate example configuration for a telescopic track which comprises only a single longitudinally extending slot for receiving a trolley connector projection.

Referring to FIGS. 12 and 13, these figures illustrate a further alternative configuration for a telescopic track construction which includes a single travel channel, each section thereof having a single longitudinally extending slot. For this configuration, both the central section 48 and the two inner sections 50 will have essentially C-like shaped cross sections but as may be appreciated from these figures this configuration still defines a travel channel as well as travel surfaces 42 and 44 for trolley component 30 which are in a common plane.

Figure 15:
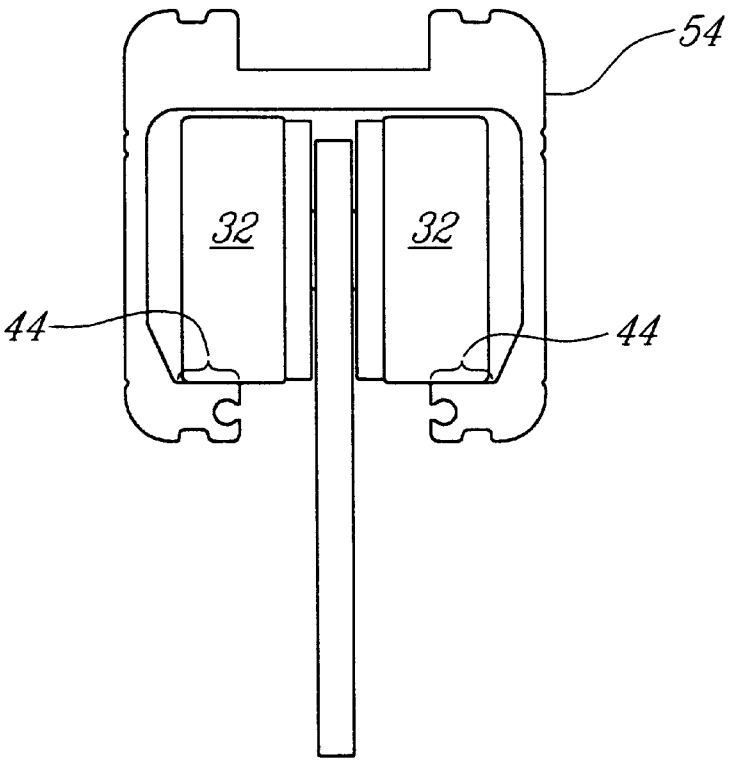
FIG. 15 is cross section view of an inner section of the alternate track as shown in FIGS. 14 in the area wherein only the inner section defines the travel path for the trolley component.
Figure 14:
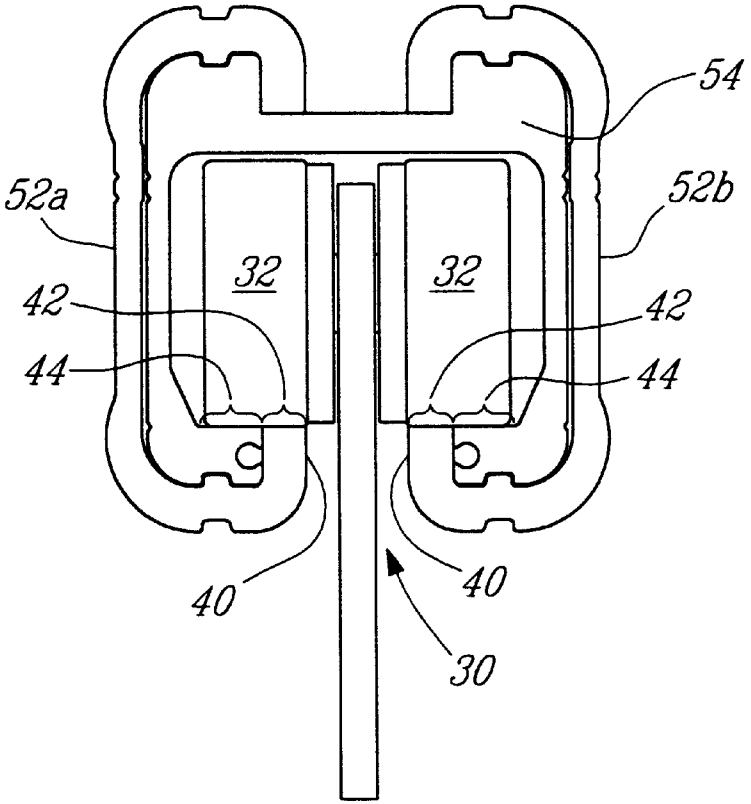
FIG. 14 is a cross sectional view similar to that shown in FIG. 6 of a further alternate example configuration for a telescopic track which comprises only a single longitudinally extending slot for receiving a trolley connector projection and wherein the outer section is defined by separate wing members.

Referring to FIGS. 14 and 15, these figures illustrate a another alternative configuration for a telescopic track construction which also includes a single travel channel, each section thereof having a single longitudinally extending slot. For this configuration, the central section 52 is comprised of wing members 52*a* and 52*b* engaging inner sections 54 much the same as the wing members 22*a* and 22*b* shown in FIGS. 5 to 10 but still define the travel channel as well as travel surfaces 42 and 44 in a common plane.

Although FIG. 1 and FIGS. 5 to 9 show a track 6 which comprises three track sections or elements, a telescopic track may, as desired, of course comprise only a single inner section and a single outer section as shown in FIGS. 4*a* and 4*b*. As a further alternative the track component may comprise a plurality of inner and outer sections as desired or as necessary. These alternate track forms will in any event define travel surfaces in a common plane in the same manner as discussed above with respect to three part tracks.

Figure 16:
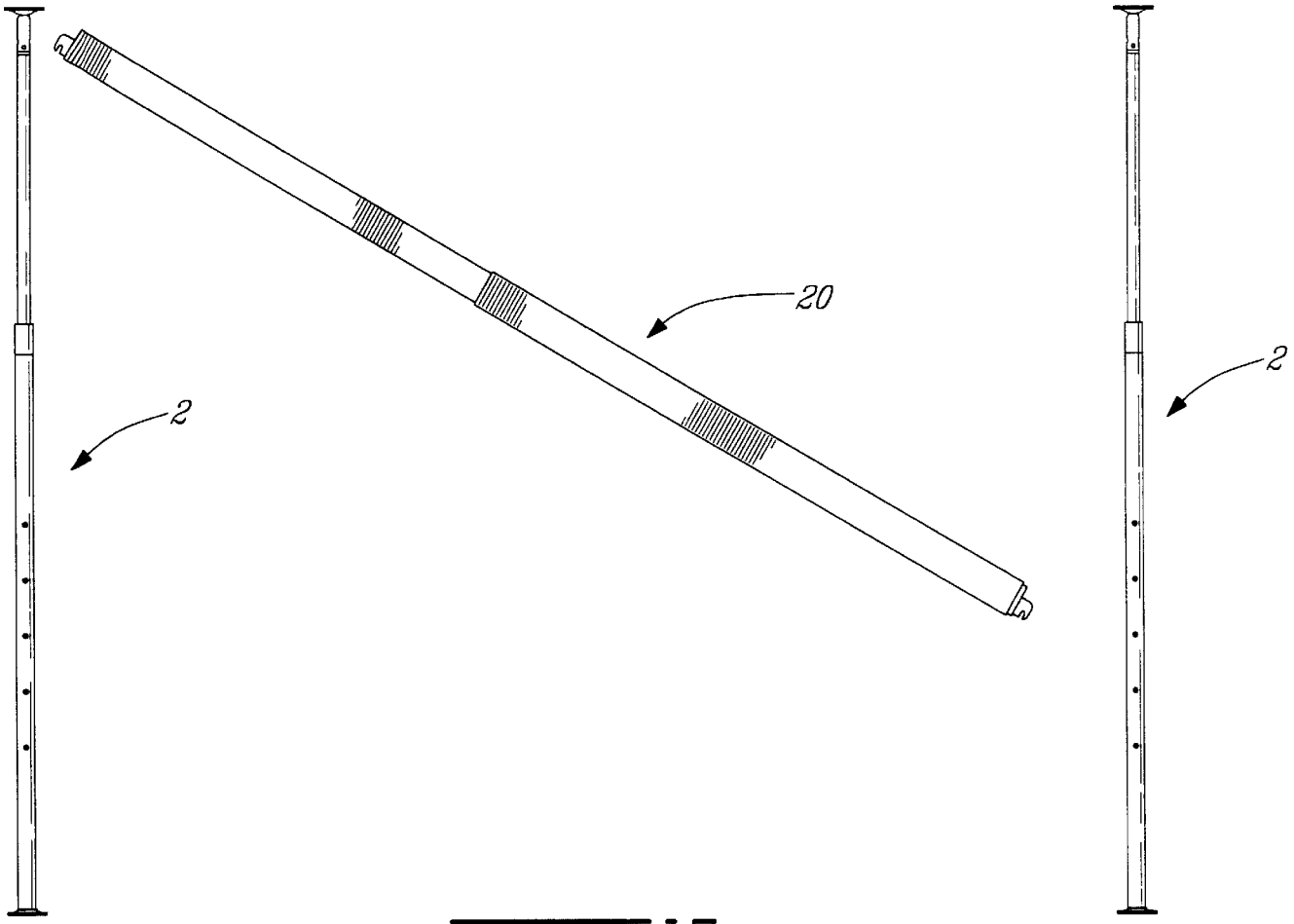
FIG. 16 is a schematic illustration of a telescopic track of the present invention in the process of being raised to be attached to a pair of masts which are disposed in upright position between an upper support structure (e.g. ceiling) and a lower support structure (e.g. floor)
Figure 17:
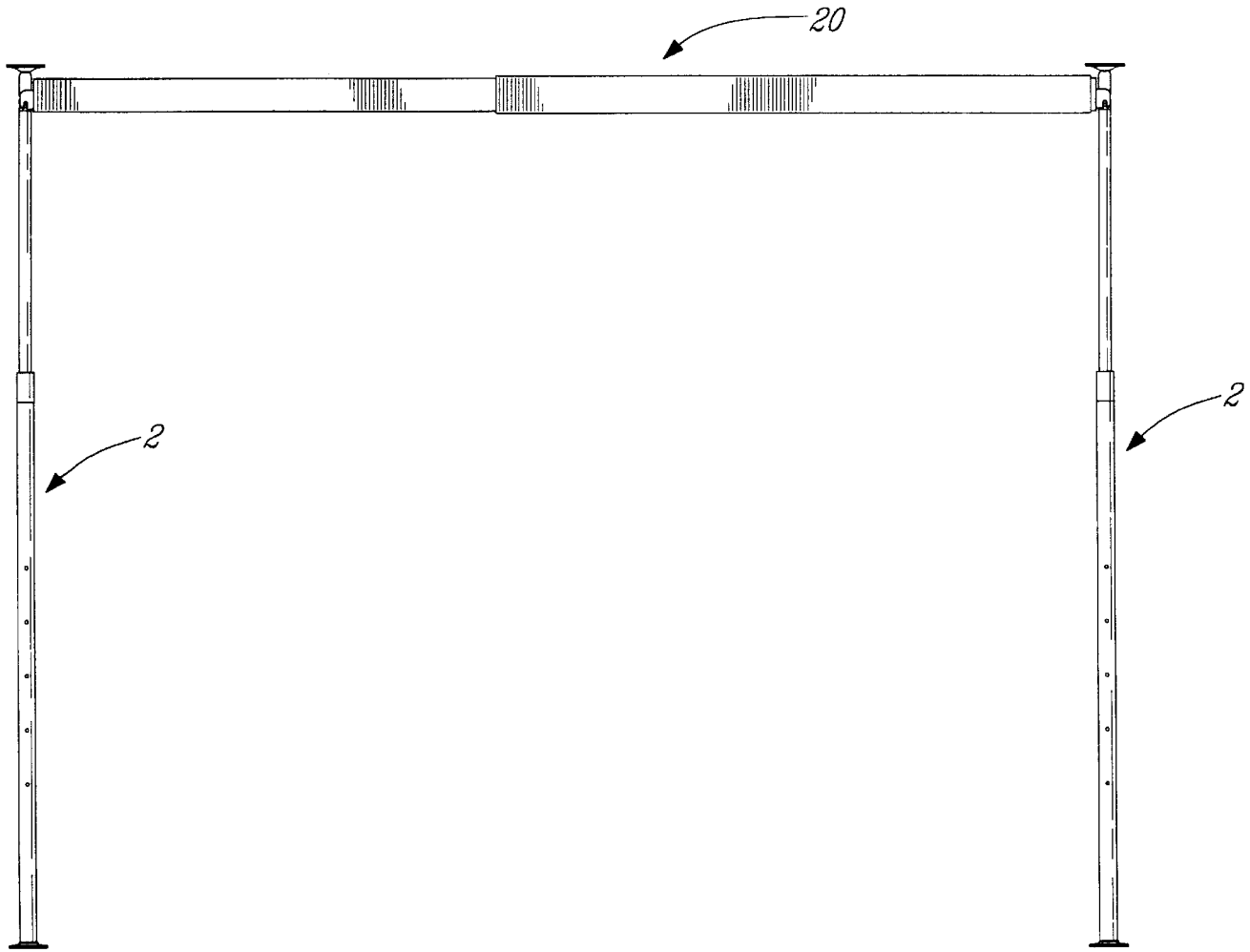
FIG. 17 is a schematic side view illustration of the overhead track system obtained from the process shown in FIG. 16.
Figure 18:
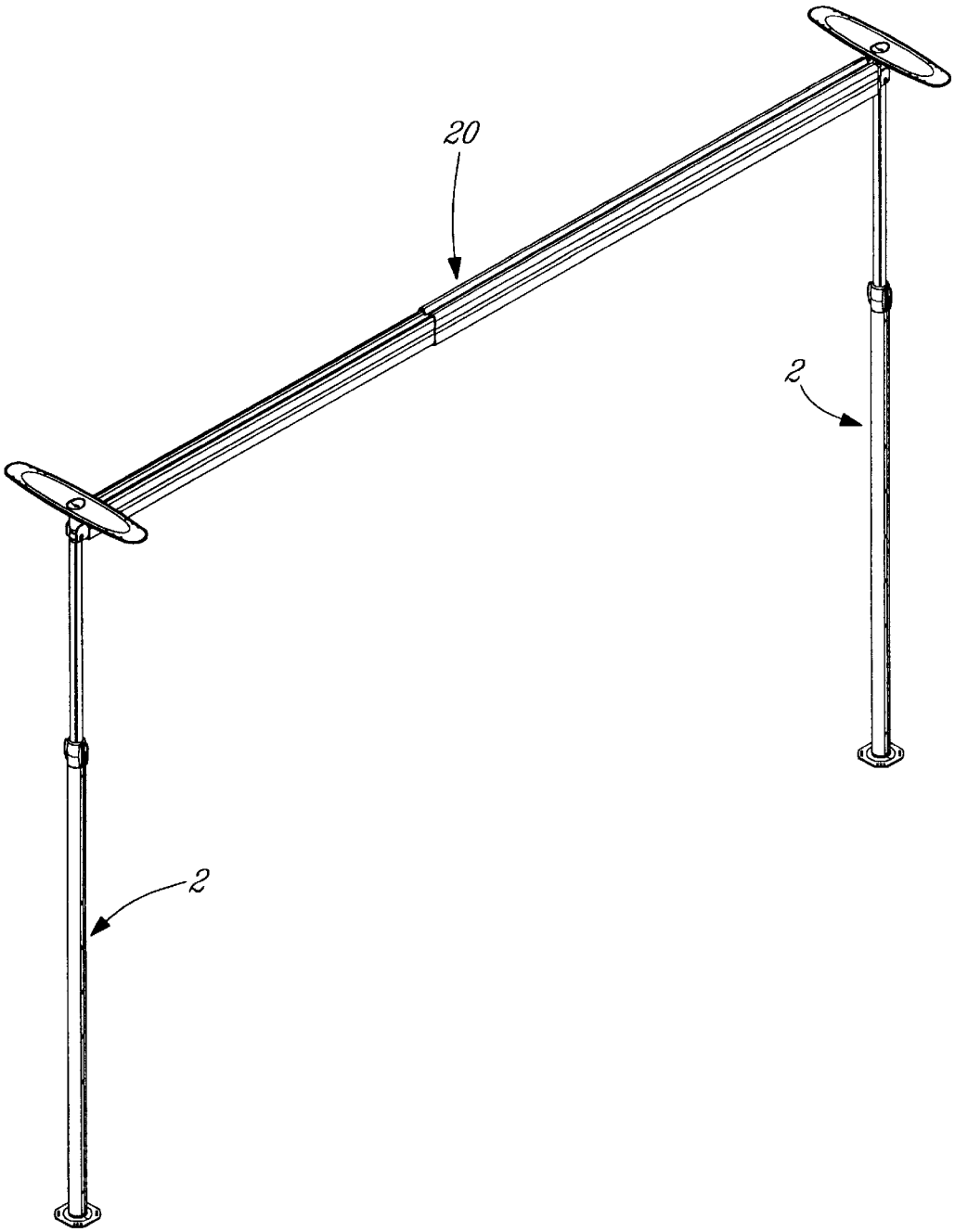
FIG. 18 is a schematic top perspective view of the overhead track system shown in FIG. 17.

Referring to FIG. 16, this figure illustrates a two part telescopic track (of FIGS. 4*a* and 4*b*) in the process of being attached to a pair of upright mast components in accordance with the present invention. The mast components are positioned (as shall be explained below) such that they firmly abut the ceiling and floor of a room (the ceiling and floor are not shown). FIGS. 17 and 18 shown the finished overhead track system for a person support system.

Referring to FIGS. 19 to 42, these figures illustrate an example mast assembly in accordance with the present invention. The mast assembly has an outer section 58 and an inner section 60 which are in telescopic engagement such that the inner section 60 may be telescopically displaced in and out of the outer section 58, i.e. the inner section 60 is disposed (coaxially) on the interior side of the outer section 58 so as to be telescopically displaceable out and into the outer section 58. The inner section 60 may also be locked in a predetermined position extending out of the outer section 58 by any suitable locking means but preferably by the snap lock means such as shall be discussed below. The inner section may 60 further include a length adjustment means for adjusting the length of the mast assembly 2 between its opposed upper and lower ends (i.e. to manually adjust the pressure being exerted by the mast component on the upper and lower surfaces during use). If desired the telescopic mast assembly may comprise three or more telescopically coupled sections wherein respective relative inner and outer sections may be lockable together as described herein.

Referring to FIGS. 19 to 22, these figures illustrate a lower portion of the mast assembly wherein the inner section or portion 60 is in a retracted position within the outer section 58 (please see FIGS. 21 and 22).

The outer section 58 of the mast assembly 2 includes a plurality of pairs of opposed first lock openings. The first lock openings on either side of the outer mast section are spaced apart along the longitudinal axis 62 of the mast assembly 2. Referring to FIG. 9 the first lock openings 64 are seen in space relation; the opposite first lock openings are hidden from view on the opposite side of the outer section 58.

As may be seen in FIGS. 21, 22 and 30, the inner section 60 of the mast assembly 2 comprises a base component or part 66 which includes a chamber or housing in which is placed a U-shaped snap lock retention member 70. The chamber is defined by a cylindrical side wall 72 which is closed off at both open ends by cap members 74 and 75. The chamber side wall 72 defines a pair of opposed second lock openings 76 (see for example FIG. 34). Referring to FIGS. 23, 24, 25 and 26, these figures show in more detail an example U-shaped snap lock retention member 70. The retention or snap lock member 70 comprises a U-shaped spring element which has a pair of spring arms 78 and 79. The spring arms 78 and 79 are shown as being connected together at their bases by a common bridge member 80. The snap lock member 70 also has a pair of lock projections 82 and 84 each of which projects from a respective free-end of a spring arm 78 and 79. The U-shaped spring element acts as a bias means and is configured and disposed as may be seen in the figures so as to be able to urge or bias the lock projections 82 and 48, (once respective second and first lock openings are aligned), to tend to move radially outward to a biassed lock position as described herein. It is to be understood herein that the word aligned as used in relation to a second lock opening and a first lock opening characterises the lock openings as being disposed relative to each other such that, for example, the peripheral edges (or rims) defining the openings do not prevent the displacement of a lock projection between a lock and unlock position as described herein.

In an alternative configuration instead of being connected together at the common base 80, the base each respective spring arm 78 and 79 could instead be separately fixed in any suitable manner to the adjacent chamber side wall (e.g. by a screw through a slot like opening in the base of the spring arm so as to allow a longitudinal degree of movement); see FIG. 31.

Figure 19:
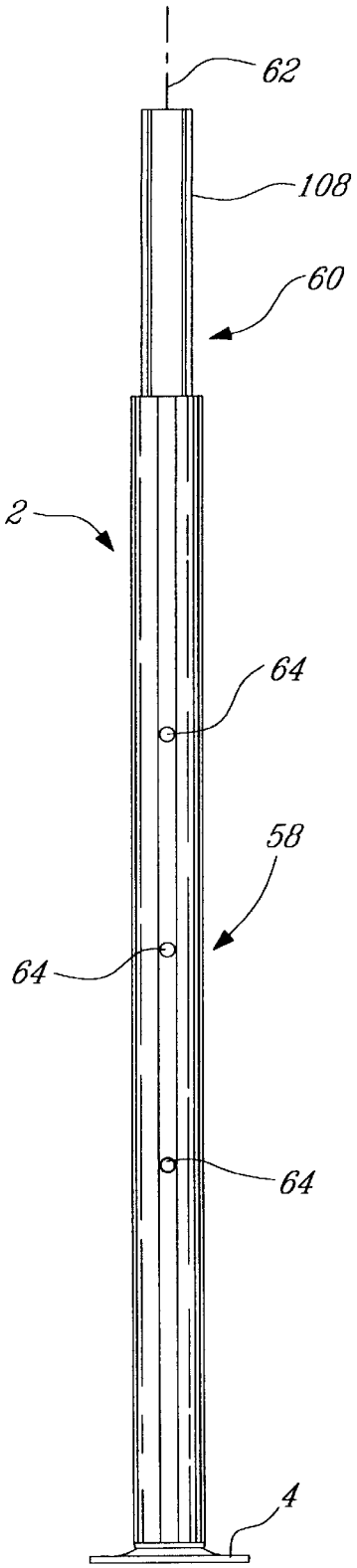
FIG. 19 is a schematic side view of an example mast assembly in accordance with the present invention showing a portion of the inner section thereof and the outer section thereof with a plurality of longitudinally spaced first lock opening.
Figure 20:
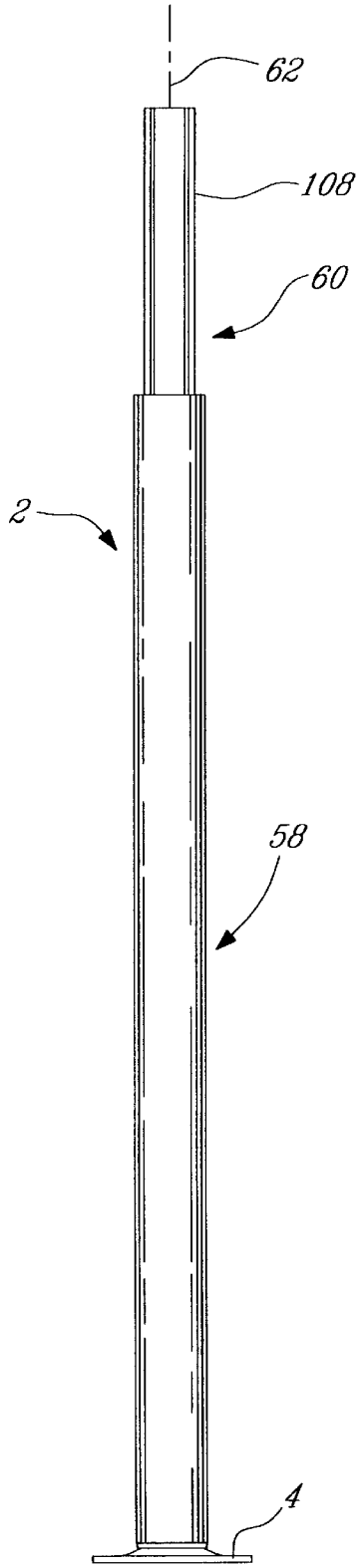
FIG. 20 is a schematic view of the example mast shown in FIG. 19 from a side having no lock openings.

In any event as may be seen from FIGS. 28 to 30 and 34 the side wall 72 of the chamber includes the above mentioned pair of opposed second lock openings 76 (see FIG. 34) through which, as may be seen from FIG. 19, extend the above-mentioned lock projections 82 and 84. The U-shaped snap lock retention member 70 is not fixed to the side wall 72 of the chamber. The base of each of the spring arm 78 and 79 adjacent the bridge member 80 slidingly abuts against the interior surface of the chamber side wall sufficiently so as to maintain the retention member in place when the lock projections are in an unlock position (see FIGS. 21 and 34) but still allow a degree of freedom of movement along the longitudinal axis 62 to allow the peripheral edge (or rim) of a second lock opening 76 to engage a lock notch as described below when the projections are 82 and 84 in a lock position and the mast assembly 2 is subjected to compression forces or stress.

Referring back to FIG. 25, the lock projections 82 and 84 each have an upper lock abutment notch 88 for engaging the peripheral wall edge (or rim) which defines the second lock openings 76. The lock projections 82 and 84 also have another opposed abutment surface 90 on the opposite side of the body thereof intended to abut the peripheral wall edge (or rim) of respective first lock openings 64. Still referring to FIG. 25, when the mast assembly 2 is in an upright position and subject to compression forces (i.e. the mast assembly is exerting pressure on the upper and lower support surfaces) the second and first lock opening will tend towards an offset position relative to each other. The lock projections 82 and 84 of the U-shaped snap lock member 70 are so disposed that when the mast assembly 70 is subject to such compression forces the edge of the first lock opening pushes the lock projection in the direction of the arrow 90 such the edge of the respective second opening is pushed into the lock notch 88; once the second opening is seated in the lock notch 88 the lock projection is not displaceable to an unlock position. The lock notch feature may as desired be eliminated but its presence is preferred since the lock notch will inhibit or prevent an undesired displacement of the lock projections to an unlock position which could cause the mast assembly to collapse when subjected to a working load.

The lock projections 82 and 84 are also shown with upper and lower camming (or cam) surfaces 92 and 94 with the upper camming surface 92 being more pronounced than the lower camming surface 94. Once the projections 82 and 84 are in a non-lock position as shall be explained below a quick tug on the inner section 60 along the longitudinal axis, outwardly of the outer section 58, will induce the upper camming surface 92 to quickly slide over the edges of the unwanted first lock openings 64 until a more distant or the desired first lock opening 64 is reached, i.e. until the inner section 60 is extended out of the outer section 58 the desired degree. On the other hand, the lower camming surface 94, once the lock projections 82 and 84 are manually displaced to a non-lock position, facilitates the displacement of the inner section 60 from a first lock opening pair to the next lower adjacent first lock opening pair. In any case the lock projections 82 and 84 must be manually maintained in non-lock positions wherein the camming surfaces thereof are able to engage the interior side of the inner section 60 (see FIGS. 21 and 34).

Referring in particular to FIGS. 22, 32 and 35, these figures show the lock projections 82 and 84 each extending through respective first and second lock openings 64 and 76 such that the aforementioned lock notch 88 and abutment surface 94 inhibit the longitudinal displacement of the inner mast section 60 along the longitudinal axis 62 of the mast assembly 2, i.e. the projections 82 and 84 extend outwardly out of first lock openings so as to impede longitudinal displacement of the inner section 60.

On the other hand when it is desired to longitudinally displace the inner mast section 60 along the longitudinal axis of the mast component any pressure being exerted on the abutment surface 94 of the lock projections by the edges of the first lock openings 64 must be removed such as for example by appropriately manipulating the length adjustment mechanism described below to relieve such compression stress or pressure, (i.e. so as to remove the edge of the second lock opening from the lock notch if present). Thereafter, both of the lock projections 82 and 84 are pressed by the fingers of a user so as to be displaced inwardly to an unlocked position (see FIGS. 21 and 34) wherein lock projections are either disposed outside of respective first lock openings or sufficiently outside of respective first lock openings such that the sliding cam surfaces 92 (or 94) of the lock projections 82 and 84 are able to slidingly engage the peripheral edges (or rims) of the first lock openings 64 which action tends to further induce the lock projections 82 and 84 to be displaced further inwardly so as to allow the inner section 60 to be (quick) displaced upwardly (or downwardly) to a new lock position.

Once in the new lock position, the second opening and the new first openings are aligned and under the influence of the bias spring effect of the spring arms 78 and 79, the respective lock projections 82 and 84 will be urged to pass into the new first lock openings such that the projections are disposed both in the respective second opening and the new respective first opening in a lock position.

Referring to FIGS. 27 and 31, although the lock mechanism for locking the inner and outer sections 60 and 58 of the mast assembly 2 has been described by way of example with respect to a pair of first lock openings 64 and a U-shaped retention member, the lock mechanism may include a single row of first lock elements associated with a single spring biassed lock projection as shown in FIG. 27. The lock projection may in this case be associated with a spring arm as for the U-shaped retention member but wherein the base thereof is fixed to the chamber side wall 72 by a rivet extending through a longitudinal slot opening 98, the rivet 100 inhibiting lateral movement of the spring arm but not screwed so tight as to totally inhibit longitudinal movement, i.e. the spring arm has a sufficient degree of movement available so as to allow operation of the lock notch 88.

Also as an alternative the spring bias action associated with a lock projection may be provided by a helical spring means acting on the lock projection(s) transversely to the longitudinal axis of the mast assembly; the helical spring means being configured and disposed in any suitable manner.

As may be understood from FIGS. 19 to 34, the mast assembly may be quick extended to a desired lock position due to the presence of the pronounced upper cam or sliding surface 92 of each of the lock projections 82 and 84, to a position wherein the mast assembly 2 engages the desired or available upper and lower support surfaces, e.g. an upper load distribution member is pressed up against an upper support surface (e.g ceiling) and a lower load distribution member is pressed up against a lower support surface (e.g floor).

The initial contact with the upper and lower support surfaces may, however, not subject the mast assembly 2 to a strong enough compression force to ensure that the mast assembly 2 will remain upright during use, i.e, in upright position as shown in FIG. 18.

Each of the mast assemblies 2 shown in FIG. 1 may, thus, for example each include means for augmenting or adjusting the pressure exerted by the mast assembly on the lower and upper support surfaces, i.e. by adjusting the overall stress length of the mast assembly.

Referring in particular to FIGS. 21, 22, 28 to 39, the mast component is provided with length or pressure adjustment means for adjusting the length of the mast between the upper and lower support surfaces (and hence the pressure being exerted on the upper and lower support surfaces by the mast assembly). Thus the inner section is composed of a base part 66 and an extension part 102 which are coupled together by screw coupling means comprising a rod member 104 having a screw threaded outer surface. The base part 66 comprises the above mentioned chamber in which is disposed the above described snap lock mechanism 70. The base part 66 is fixed by some suitable means (such as for example by press fitting, screws, welding, etc.) to the screw rod member 104; as shown in FIGS. 28 to 30 and 33, the screw rod member 104 is attached to the cap 74 of the chamber by a lock pin member 106. On the other hand, referring in particular to FIGS. 32 to 34, the extension part 102 of the inner section 66 comprises an elongated member 108 which at its end facing the base part 66 has a channel in which is disposed a channel member 110. The channel member 110 has inner threads which mate with the threads of the screw rod member 104 in the manner of a nut and bolt combination. The elongated member 108 has a cross sectional configuration and size relative to the interior side of the outer section 58 such that it may rotate about the longitudinal axis as described herein. Once the base part 66 of the inner section 60 is fixed in place by the snap lock retention means 70 such that it may not move along the longitudinal axis 62 (nor be able to rotate around the longitudinal axis as shall be explained below), the extension part 102 may be made to advance upwardly or downwardly along the screw rod member 104 by inducing rotation of the elongated member 108 about the longitudinal axis 62, i.e. by manually inducing the elongated member 108 to rotate.

Referring to FIGS. 35 to 38, these figures illustrate example mechanisms by which various elements of a mast assembly 2 may be immobilised relative to each other.

Turning to FIG. 36, the end caps 74 and 75 closing off the chamber containing the snap lock retention member 70 and the interior side of the outer section 58 are configured so as to have corresponding female elements 112 and male elements 114 which cooperate so as to inhibit or prevent the base part of the inner section from rotating about the longitudinal axis. The end caps 74 and 75 and the interior side of the outer section are, however, sized and configured so that they can nevertheless slidingly abut each other such that the base part 66 of the inner section 60 is displaceable along the longitudinal axis 62, i.e. so as to facilitate the telescopic lengthening or shortening of the mast assembly 2 as described herein. Thus the male elements 114 of the outer section extend the entire longitudinal length of the inner side of the outer section. If desired however these elements may be omitted in which case the lock projections alone (when in lock position) would be configured to inhibit or prevent such rotation in addition to inhibiting axial displacement of the inner section along the longitudinal axis.

Figure 37:
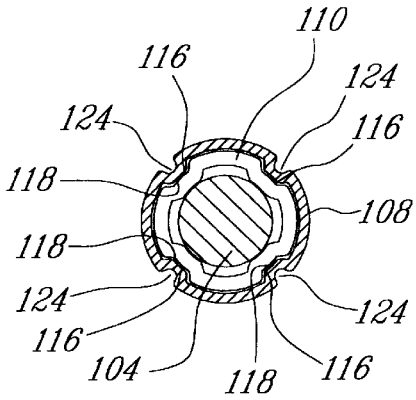

Referring to FIGS. 37 and 38 the channel member 110 as well as the elongated member 108 are likewise configured so as to have corresponding female elements 116 and male elements 118 which cooperate so as to inhibit or prevent the channel member 110 from rotating about the longitudinal axis 62 relative to the elongated member 108, i.e. manual rotation of the elongated member 108 will induce rotation of the channel member 110 about the threaded rod member 104. The female elements 116 of the channel member 110 extend the length of the channel member 110 but could if desired extend some shorter or lesser distance.

The channel member 110 as shown is also in press fit engagement with the elongated member 108 so as to inhibit axial displacement of the channel member 110 relative to the elongated member 108 along the longitudinal axis, 62 e.g. a telescopic outward pulling on the inner section 60 (the snap lock projections 82 and 84 being in non-lock position) will entrain the channel member 110 (and in turn the base part 66 of the inner section 60) in the same direction.

Any other suitable fixing means with respect to the channel member may be used keeping in mind the purpose of the channel member 110, i.e. to be displaceable screw fashion along the rod member 104; a set screw, adhesive, etc. may for example be used to tie the channel member 110 to the elongated member 108.

In order to effect manual rotation of the upper section, the mast assembly may be provided with a sliding handle 120; see FIGS. 39 to 42. The sliding handle 120 is provided with inwardly extending projections 122 which register in longitudinally extending grooves or channels 124 provided in the outer surface of the elongated member 108 of the inner section. These channels 124 and the handle projections 122 are configured and sized so as to allow the handle 120 to slide as desired upwardly and downwardly over the elongated body of the inner section 60 along the longitudinal axis 62 in the direction of the arrow 126. However, the engagement between the inwardly extending projections 122 and respective grooves 124 prevent rotation of the handle 120 about the longitudinal axis 62 relative to the inner section 60 such that a rotational displacement of the handle 120 in the direction of the arrow 130 will be transmitted to the inner section 60 inducing it to rotate and depending on the direction of rotation either cause the inner section 60 to tend to advance upwardly or downwardly along the longitudinal axis 60 of the mast assembly 2 due to the screw coupling mentioned above.

The sliding handle 120 also includes a pair of downwardly extending lock lip portions 132. These lip portions 132 are sized to register in and engage respective lock channels or slots 134 disposed at the top of the outer section 58. Accordingly, referring in particular to FIGS. 41 and 42 once the inner mast section 60 has been rotated the desired degree, the sliding handle 120 may be lowered such that the lock lip portions 132 are engaged in respective lock slots 134 which engagement will inhibit rotation not only of the handle about the longitudinal axis but as a direct consequence also inhibit rotation of the elongated member.

Referring to FIGS. 43 to 49, these figure illustrate an example mechanism whereby an upper load spreader plate element 3 may be connected to the upper end of a respective inner section 60 by a removeable intermediate connector element or member 140. The intermediate connector element 140 comprises a head portion 142 and a tail portion, the tail portion being indicated generally by the reference numeral 144. The tail portion 144 is sized to be removeably insertable into a cavity defined at the top end of the elongated member 108 of the inner section 60, i.e. the tail portion 144 slidingly engages the inner wall of the cavity disposed at the top end of the elongated member 108 which defines the walls of the cavity.

The head portion 142 comprises a channel including an opening (i.e. a sleeve element) for removably receiving a connector projection 8 extending from a load spreader plate element 3; the connector projection 8 slidingly engages the wall element defining the cavity (i.e. in a telescopic like fashion). A compression or bias spring 148 is disposed in the cavity and maintained in place by a connector pin 150 which engages a hook part 151 of the spring 148. The connector projection 8 and the compression spring 148 are configured and sized such that the compression spring 148 is able to act between the upper end of the inner section and a respective load spreader plate 8 for the purpose of providing possible compensation for any deviation in distance between the upper and lower support surfaces which may for example occur during use e.g. if the distance between the upper and lower support surfaces should increase, the compression spring 148 may nonetheless continue to urge the load spreader plate 3 tight up against the upper support surface. Thus the pressure force from the elongated member 108 may be transmitted (i.e. attenuated) to the ceiling pad through the compression spring 148. FIGS. 45 and 46 show the compression spring 148 in uncompressed configuration while FIGS. 47 and 48 show the compression spring 148 in compressed configuration.

The intermediate connector element 140 also has an annular collar like bearing member 156 (of ring like shape)

which is configured to abut against a shoulder 158 defined by the head portion 142 and also abut the top edge 160 of the inner section disposed about the opening to the cavity for receiving the tail portion; see FIG. 46 which is an enlarged view of the encircled portion of the intermediate engagement member 142. The annular bearing ring 156 is free to rotate about the longitudinal axis 62 but is inhibited from being displaced along the longitudinal axis by an inwardly extending projection 162 (which may if desired also be annular or ring like) registering in an annular recess or groove 164. The presence of the annular bearing member 156 allows the elongated member 108 to be rotated about the longitudinal axis 62 without inducing similar rotation of the load spreader plate 3.

The connector pin 150 of the intermediate connector element 140 has ends which extend out of the head portion 142 and which may be used to removeably attach a track to a mast assembly 2 in conjunction with the annular lock groove 166 defined by the head portion 142.

Referring to FIGS. 2*a* to 4*b* and FIGS. 50 to 59 the end of a track may comprise a releasable quick lock mechanism for securing respective ends of an above-described track to a mast assembly. As may be seen from FIG. 2*a* to 4*a* and more particularly with respect to FIGS. 50 to 53 each of the ends of a track is provided with a pair of spaced apart plate elements 170 connected together by a rear plate or web 172 (see FIGS. 54 and 55). Each of the plates 170 is provided with a respective downwardly open U-shaped slot 174 sized and configured to receive a respective end of a connector pin 156 so as to inhibit movement of the track transversely to the longitudinal axis 62. In the case of FIGS. 50 and 51 the plates 170 are crimp attached to the inner central web 176 connecting the sides of an inner section 24 together. In the case of FIGS. 52 and 53, these figures relate to a track in which the wing elements or members 22*a* and 22*b* of an outer section 22 are directly connected to a mast assembly 2 rather than via an inner section 24. The ends of the wing elements or members 22*a* and 22*b* of the outer section 22 are connected together by an essentially H-shaped bracket which has a cross section analogous to the cross section of the inner section 24 shown in FIG. 11; the plates 170 are crimp attached to the inner central web 178 connecting the sides of the bracket together. The plates 170 are interconnected by the above mentioned rear plate 172.

Figure 4B:
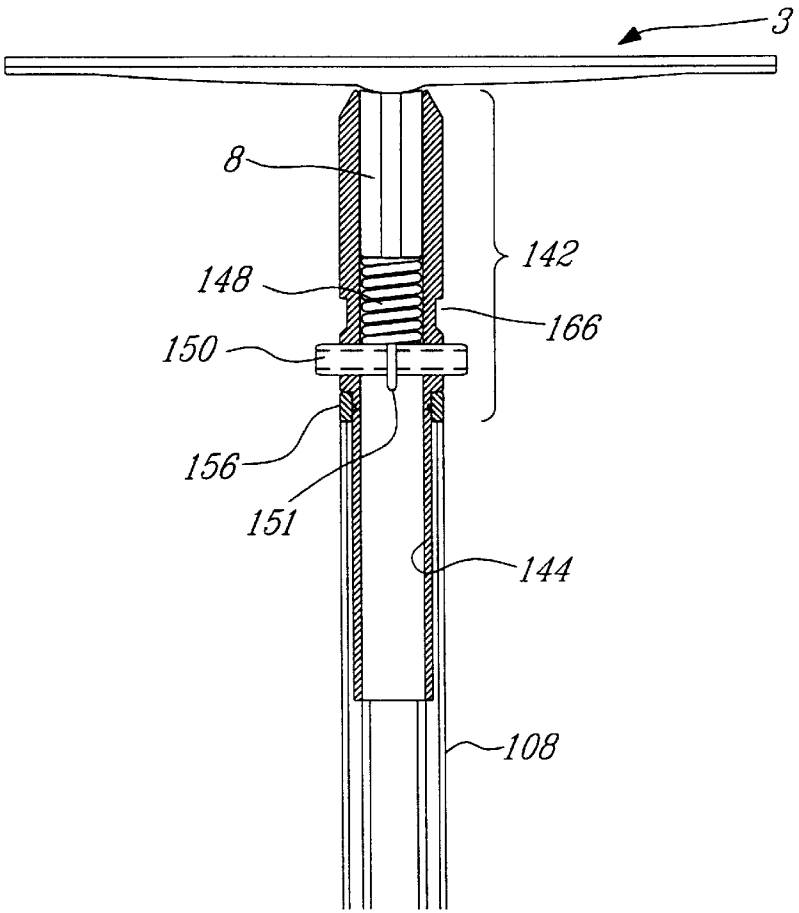
Figure 4B:
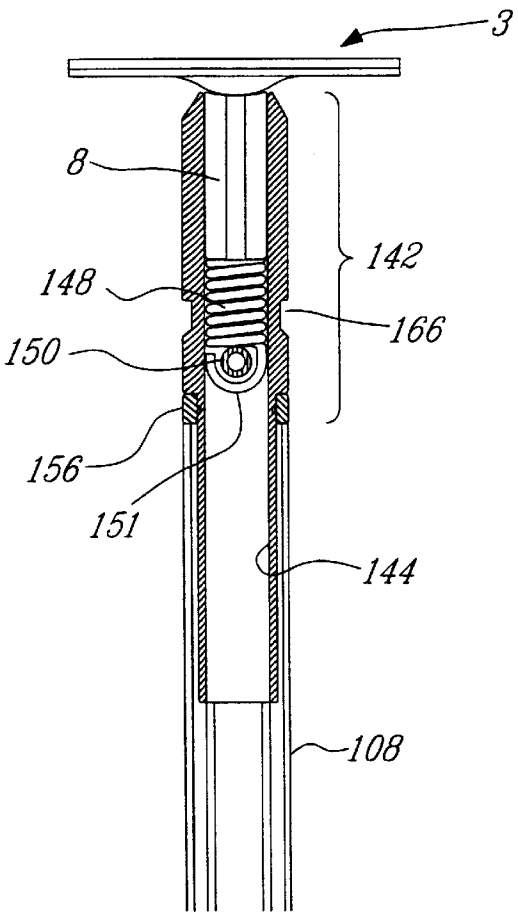
Figure 51:
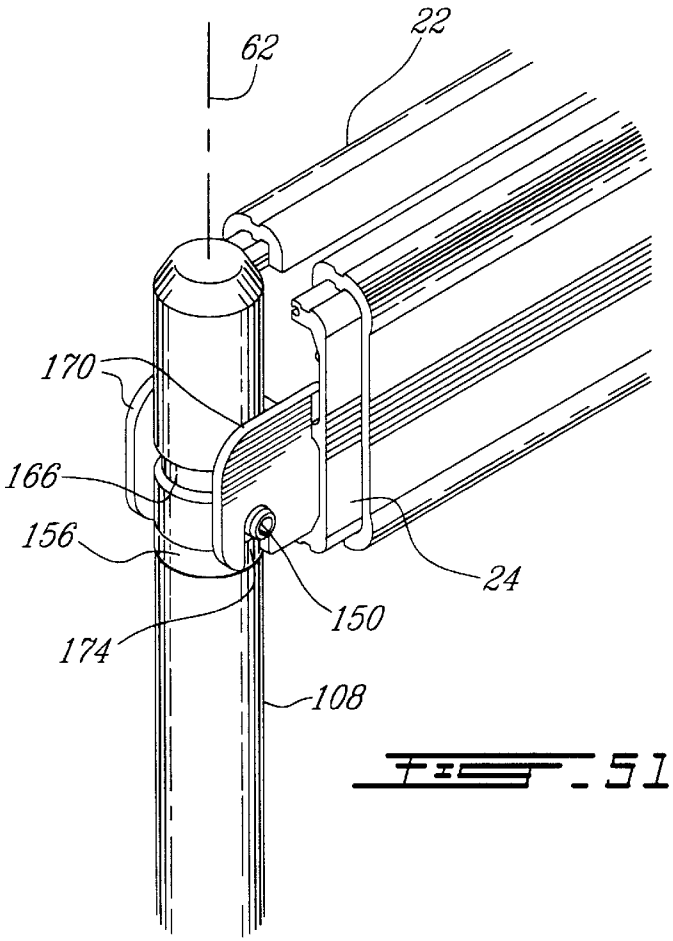
Figure 50:
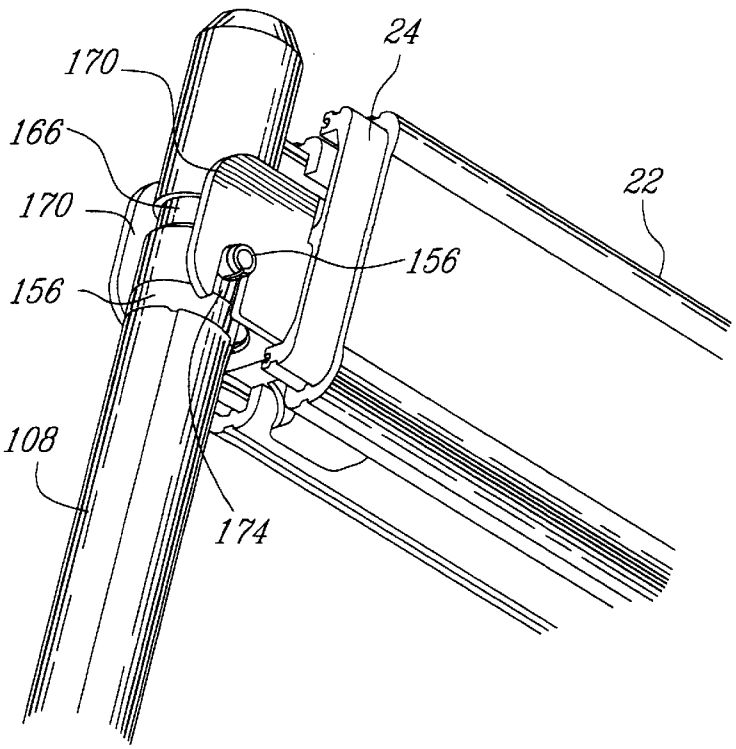

Referring to FIGS. 4 and 55 the quick lock mechanism additionally includes a releasable snap lock component 182 having a body comprising lock projection 184 for registering in the annular lock groove 166 defined by the intermediate connector element 140. The snap lock component 182 also has a bias spring 186 which is disposed up against the body of the snap lock component 182 and the rear plate 172 (see FIG. 55) so as to be able to act between the body of the lock component 182 and the rear plate 172 such that the lock projection 184 is releasably displaceable from a biassed working position wherein the lock projection 184 is registered in the annular lock groove 166 (dotted outline in FIG. 55—see also FIG. 59) and a release position (solid outline) from which the track may be removed from the mast assembly i.e. to allow the connector pin 156 to be removed from the U-shaped slot 174. In the biassed working position the lock projection 184 registers in the lock groove 166 so as to inhibit movement along the longitudinal axis 62.

The releasable snap lock component may be displaced between the working and release positions by manually pushing on the button member 188 against the biassing action of the bias spring.

As may be seen from FIG. 54 the plates 170 each have side notches for receiving respective projections on opposite sides of the body of lock component 182; one such notch is designated by the reference numeral 200 and its respective projection is designated by the reference numeral 202. The notch 200 and projection 202 will act to limit the forward and rear displacement of the lock component in the direction of the arrow 190 see FIG. 55. FIGS. 56 to 59 illustrate a track in the process of being attached to a mast assembly using the snap lock component.

Although not shown, as an alternative the snap lock component may comprise a pivotal hook member which is pivotally attached to the body defining the U-shaped slots and a bias spring biassing the hook member in a working position. The hook member may also be pivotable between the biassed working position wherein a lock projection of the hook blocks off the U-shaped slot and a release position wherein the lock projection is disposed away from the opening of the U-shaped slot so that the track may be removed from the mast component, i.e. to allow the connector pin to be removed from the U-shaped slot. The pivotable hook attachment mechanism may be provided with a cam or sliding surface over which the connector pin may slide so as to automatically urge the lock projection from its biassed lock position and allow the pin to pass into the lock U-shaped slot, i.e. in quick lock fashion without having to manually depress or displace the handle of the handle member to open up the U-shaped slot. The pin may be released by pushing on a button member against the biassing action of the bias spring, Referring to FIGS. 60 to 62, these figures show an alternate embodiment of a mast supported overhead rail component which comprises three mast components and two overhead rail components as described above. Referring to FIGS. 60 and 61 and in particular to FIG. 61, the lower upper rail component is held in place at one end by a double trolley system 208 wherein one trolley component is disposed in the lower travelling channel of the upper overhead rail component and the lower trolley component connected to the upper component by a rod member 210 is disposed in the upper travel channel of the lower overhead rail component.

With respect to the trolley component which may be used to travel through the travel channels of a telescopic track as described herein, the trolley component may (as seen above) be a wheeled carriage having a (downwardly) extending connector projection for attachment to a winch assembly such as for example an assembly shown in Canadian Patent application no. 2,217,421 (and in the corresponding International patent application number PCT/CA98/00935 which was published under International Publication number. WO 99/17704). The carriage may also comprise two pairs of opposite wheels, each pair of wheels being supported on a respective travel surface as described herein. The trolley once installed onto the travel channel of the track may be displaced or rolled manually about the travel path defined by the track component. It is noted that although the trolley illustrated in the figures herein is wheeled, he trolley may alternatively not be wheeled but have sliding members for contact with the travel surface. These sliding members may comprises members which have a reduced friction characteristic such as Teflon.

We claim:

1. A telescopic track comprising an inner section and an outer section, said outer section having an exterior side and an interior side, said inner section being disposed on the interior side of said outer section so as to be telescopically displaceable in and out of said outer section, said outer and inner sections defining a travel channel for a trolley means comprising a trolley connector projection, said outer section having a longitudinally extending first opening through which may extend said trolley connector projection, the first opening of the outer section being defined by opposed inwardly extending slot projections extending into the interior side of the outer section, each of the slot projections terminating in a respective first interior support surface, said inner section having a longitudinally extending second opening through which may extend said trolley connector projection, the inner section having interior surface portions bordering the second opening on opposite sides thereof defining respective second interior support surfaces, the slot projections being configured to register within the second opening such that the first and second interior support surfaces are in an essentially common plane and define a travel support surface for the trolley component.

2. A telescopic track as defined in claim 1 comprising two of said inner sections coupled together by said outer section.

3. In a person support system for use in a room having a floor and a ceiling, said system comprising an overhead track component have opposed ends at least two upstanding mast components connecting means connecting each end of said track component to a respective mast assembly the improvement wherein said mast components comprise one or more mast assemblies as defined in claim 2.

4. In a person support system for use in a room having a floor and a ceiling, said system comprising an overhead track component having opposed ends at least two upstanding mast components connecting means connecting each end of said track component to a respective mast assembly the improvement wherein said overhead track component comprises one or more telescopic tracks as defined in claim 1.

5. A telescopic mast assembly having a longitudinal axis and comprising an outer section having an interior side and an exterior side, an inner section, said inner section being disposed on the interior side of said outer section so as to be telescopically displaceable in and out of said outer section along said longitudinal axis, and a releasable snap lock component comprising bias means, a lock projection, a plurality of longitudinally spaced first lock openings defined by one of said inner and outer sections and a second lock opening defined by the other of said inner and outer sections, said outer section, said inner section, said bias means, said lock projection and said second opening being configured such that said second lock opening is alignable with said first lock openings and such that when said second lock opening is aligned with a first lock opening said lock projection is displaceable between a biassed lock position and an unlock position said bias means being configured so as to able to bias said lock projection in said biassed lock position said bias means being configured so as to able to bias said lock projection in said biassed lock position wherein when said lock projection is in said biassed lock position said lock projection is disposed in said second lock opening and in the first lock opening so as to inhibit telescopic displacement of said inner section along said longitudinal axis relative to said outer section, and wherein when said lock projection is in said unlock position said inner section is telescopically displaceable along the longitudinal axis relative to said outer section.

6. A mast assembly as defined in claim 5 wherein said inner section comprises an extension component and a base component, wherein said base component comprises said bias means, said lock projection and defines said second lock opening of said releasable snap lock component, wherein said outer section and said base component are configured to cooperate so as to inhibit rotation of said base component about said longitudinal axis relative to said outer section and wherein said mast assembly further comprises coupling means for screw coupling said extension component and said base component together such that, when said base component is locked by the releasable snap lock component so as to inhibit displacement of said inner section along said longitudinal axis relative to said outer section, rotation of the extension component about the longitudinal axis relative to the base component is able to induce displacement of said extension component relative to said base component along said longitudinal axis.

7. In a person support system for use in a room having a floor and a ceiling, said system comprising an overhead track component having opposed ends at least two upstanding mast components connecting means connecting each end of said track component to a respective mast assembly the improvement wherein said mast component comprises one or more mast assemblies as defined in claim 6.

8. Mast assembly having a longitudinal axis and comprising an outer section having an interior side and an exterior side, an inner section comprising an extension component and a base component, said inner section being disposed on the interior side of said outer section so as to be telescopically displaceable in and out of said outer section along said longitudinal axis, a releasable lock means for locking the inner section in place with respect to said outer section so as to inhibit displacement of said inner section along said longitudinal axis relative to said outer section anti-rotation means configured so as to be able to inhibit rotation of said base component about said longitudinal axis relative to said extension component and said mast assembly further comprises coupling means for screw coupling said extension component and said lower component together such that when said inner section is locked in place relative to the outer section so as to as to inhibit displacement of said inner section along said longitudinal axis, rotation of the extension component about the longitudinal axis relative to the base component is able to induce displacement of said extension component relative to said base component along said longitudinal axis.

9. A kit for a person support system comprising an overhead track component, a mast component and releasable connecting means for connecting said overhead track component to said mast component wherein said overhead track component comprises a telescopic track, said track comprising an inner section and an outer section, said outer section having an exterior side and an interior side, said inner section being disposed on the interior side of said outer section so as to be telescopically displaceable in and out of said outer section, said outer and inner sections defining a travel channel for a trolley means comprising a trolley connector projection, said outer section having a longitudinally extending first opening through which may extend said trolley connector projection, the first opening of the outer section being defined by opposed inwardly extending slot projections extending into the interior side of the outer section, each of the slot projections terminating in a respective first interior support surface, said inner section having a longitudinally extending second opening through which may extend said trolley connector projection, the inner section having interior surface portions bordering the second opening on opposite sides thereof defining respective second interior support surfaces, the slot projections being or configured to register within the second opening such that the first and second interior support surfaces are in an essentially common plane and define a travel support surface for the trolley component and wherein said mast component comprises at least two mast assemblies, each mast assembly having a longitudinal axis and comprising an outer section having an interior side and an exterior side, an inner section, said inner section being disposed on the interior side of said outer section so as to be telescopically displaceable in and out of said outer section along said longitudinal axis and a releasable snap lock component comprising bias means, a lock projection, a plurality of longitudinally spaced first lock openings defined by one of said inner and outer sections and a second lock opening defined by the other of said inner and outer sections, said outer section, said inner section, said bias means, said lock projection and said second opening being configured such that said second lock opening is alignable with said first lock openings and such that when sad second lock opening is aligned with a first lock opening said lock projection is displaceable between a biassed lock position and an unlock position said bias means being configured so as to able to bias said lock projection in said biassed lock position wherein when said lock projection is in said biassed lock position said lock projection is disposed in said second lock opening and in the first lock opening so as to inhibit telescopic displacement of said inner section along said longitudinal axis relative to said outer section, and wherein when said lock projection is in said unlock position said inner section is telescopically displaceable along the longitudinal axis relative to said outer section.

10. A kit as defined in claim 9 wherein for at least one of said mast assemblies said inner section thereof comprises an extension component and a base component, said base component thereof comprises said bias means, said lock projection and defines said second lock opening of said releasable snap lock component, said outer section and said base component thereof are configured to cooperate so as to inhibit rotation of said base component about said longitudinal axis relative to said outer section and said mast assembly further comprises coupling means for screw coupling said extension component and said base component together such that, when said base component is locked by the releasable snap lock component so as to inhibit displacement of said inner section along said longitudinal axis relative to said outer section, rotation of the extension component about the longitudinal axis relative to the base component is able to induce displacement of said extension component relative to said base component along said longitudinal axis.

11. A person support system for use in a room having a floor and a ceiling, said system comprising an overhead track component having opposed ends at least two upstanding mast components connecting means connecting each end of said track component to a respective mast assembly wherein at least one of said mast components is of telescopically variable length and comprises a component of compression variable length for causing upper and lower ends thereof to respectively engage upper and lower support surfaces.

12. A person support system for use in a room having a floor and a ceiling, said system comprising an overhead track component having opposed ends at least two upstanding mast components connecting means connecting each end of said track component to a respective mast assembly wherein each of said mast components is of telescopically variable length and comprises a component of compression variable length for causing upper and lower ends thereof to respectively engage upper and lower support surfaces.

* * * * *